US006115561A

United States Patent [19]

Fukushima

[11] Patent Number: 6,115,561

[45] Date of Patent: Sep. 5, 2000

[54] IMAGE FORMING APPARATUS AND A CONTROLLING METHOD OF AN IMAGE FORMING APPARATUS

[75] Inventor: Satoru Fukushima, Yokohama, Japan

[73] Assignee: Canon Kabushiki Kaisha, Tokyo, Japan

[21] Appl. No.: 08/896,546

[22] Filed: Jul. 18, 1997

[30] Foreign Application Priority Data

Jul. 22, 1996 [JP] Japan ..... 8-192584

[51] Int. Cl.[7] ..... G03G 15/00

[52] U.S. Cl. ..... 399/49; 399/58

[58] Field of Search ..... 399/49, 58, 53, 399/60, 72, 61

[56] References Cited

U.S. PATENT DOCUMENTS

| | | | |
|---|---|---|---|
| 4,647,184 | 3/1987 | Russell et al. | 399/48 |
| 5,122,835 | 6/1992 | Rushing et al. | 399/49 |
| 5,305,060 | 4/1994 | Fukushima . | |
| 5,337,136 | 8/1994 | Knapp et al. | 399/299 |
| 5,436,705 | 7/1995 | Raj | 399/59 |
| 5,583,644 | 12/1996 | Sasanuma et al. . | |
| 5,710,958 | 1/1998 | Raj | 399/49 |
| 5,749,019 | 5/1998 | Mestha | 399/46 |

*Primary Examiner*—Robert Beatty
*Attorney, Agent, or Firm*—Fitzpatrick, Cella, Harper & Scinto

[57] ABSTRACT

The present invention corrects and controls both short-term changes in the density and gradation of the obtained image due to changes in the environment and the like, and long-term changes in the density and gradation of the obtained image due to changes in the properties of the photosensitive member and the developer during a long use period using two kinds of density control operations. In first density control, a predetermined pattern is formed on a recording material via a visual-image forming process, and a contrast potential and an LUT (look-up table) for gamma conversion are set based on the value of density of the formed pattern and in a second density control, control is performed by controlling an amount of replenishment of a toner according to a first reference value, which is corrected based on the difference between the value of density of a pattern formed on a photosensitive drum and a second reference value, thereafter a pattern is formed on the photosensitive drum by driving the visual-image forming process with a parameter set in the first density control, and the first and second reference values are corrected based on the value of density of the formed pattern.

34 Claims, 16 Drawing Sheets

IMAGE FORMING APPARATUS AND A CONTROLLING METHOD OF AN IMAGE FORMING APPARATUS

BACKGROUND OF THE INVENTION

1. Field of the Invention

This invention relates to an image forming apparatus, such as a copier, a printer or the like which uses an electrophotographic method, an electrostatic recording method or the like, and to a method for controlling such an apparatus.

2. Description of the Related Art

In image forming apparatuses which use an electrophotographic method, an electrostatic recording method or the like, an approach for improving the stability of image quality by forming a specific pattern on an image bearing member, reading the density of the formed pattern, and correcting the density and gradation of the pattern is known. In another approach for improving the stability of image quality, a specific pattern is formed on a recording material, the density of the formed pattern is read, and the density and gradation of the formed pattern is corrected.

However, it is difficult to satisfactorily correct and control both short-term changes in the reproducibility of the density and gradation of the obtained image caused, for example, by changes in environment, and long-term changes in the reproducibility of the density and gradation of the obtained image caused, for example, by changes in the properties of the photosensitive member and the developer during the use of a long time period, only according to the above-described correction methods.

In order to solve the above-described problems, the assignee of the present application has provided proposals in U.S. Pat. No. 5,583,644 and U.S. Ser. No. 409,811 (filed Mar. 24, 1995). However, there is still room for improvement in dealing with short-term changes in the reproducibility of the density and gradation of the obtained image.

SUMMARY OF THE INVENTION

The present invention has been made in consideration of the above-described problems.

It is an object of the present invention to satisfactorily correct and control both short-term changes in the reproducibility of the density and gradation of the obtained image caused, for example, by changes in environment, and long-term changes in the reproducibility of the density and gradation of the obtained image caused, for example, by changes in the properties of the photosensitive member and the developer during long use periods.

According to one aspect, the present invention which achieves the above-described object relates to an image forming apparatus which includes first forming means for forming a first pattern on a recording material, first detection means for detecting a density of the first pattern, first control means for controlling the image forming apparatus based on the density detected by the first detection means, second forming means for forming a second pattern on an image bearing member, second detection means for detecting a density of the second pattern, second control means for controlling the image forming apparatus based on the density detected by the second detection means, and adjusting means for adjusting a state of control by the second control means based on a result of control by the first control means.

According to another aspect, the present invention which achieves the above-described object relates to an image forming apparatus which includes forming means for forming a pattern on a recording material via a visual-image forming process, first control means for setting a parameter based on a value of density of the pattern formed by the visual-image forming process, second control means for controlling a density of the recording material by maintaining the value of density of the pattern formed in the visual-image forming process to a predetermined target value, and adjusting means for forming a pattern by driving the visual-image forming process with the parameter set by the first control means and for updating the predetermined target value based on a value of density of the formed pattern.

According to still another aspect, the present invention which achieves the above-described object relates to a method for controlling an image forming apparatus. The method includes a first forming step of forming a first pattern on a recording material, a first detection step of detecting a density of the first pattern, a first control step of controlling the image forming apparatus based on the density detected by the first detection step, second forming step of forming a second pattern on an image bearing member, a second detection step of detecting a density of the second pattern, a second control step of controlling the image forming apparatus based on the density detected by the second detection step, and an adjusting step of adjusting a state of control in the second control step based on a result of control by the first control step.

According to yet another aspect, the present invention which achieves the above-described object relates to a method for controlling an image forming apparatus. The method includes a forming step of forming a pattern on a recording material via a visual-image forming process, a first control step of setting a parameter based on a value of density of the pattern formed by the visual-image forming process, a second control step of controlling a density of the recording material by maintaining the value of density of the pattern formed in the visual-image forming process to a predetermined target value, and an adjusting step of forming a pattern by driving the visual-image forming process with the parameter set by the first control step and updating the predetermined target value based on a value of density of the formed pattern.

The foregoing and other objects, advantages and features of the present invention will become more apparent from the following detailed description of the preferred embodiments taken in conjuction with the accompanying drawings.

DETAILED DESCRIPTION OF THE PREFERRED EMBODIMENTS

The preferred embodiments of the present invention will now be described in detail with reference to the drawings. In the following embodiments, the present invention is applied to an electrophotographic color copier having a plurality of photosensitive drums. However, the present invention is applied not only to such a copier, but may, of course, be also applied to each kind of electrophotograhic copier or printer, such as one having a single photosensitive drum, a monochromic copier or printer, or an image forming apparatus other than an electrophotographic apparatus.

First Embodiment

Figure 1:
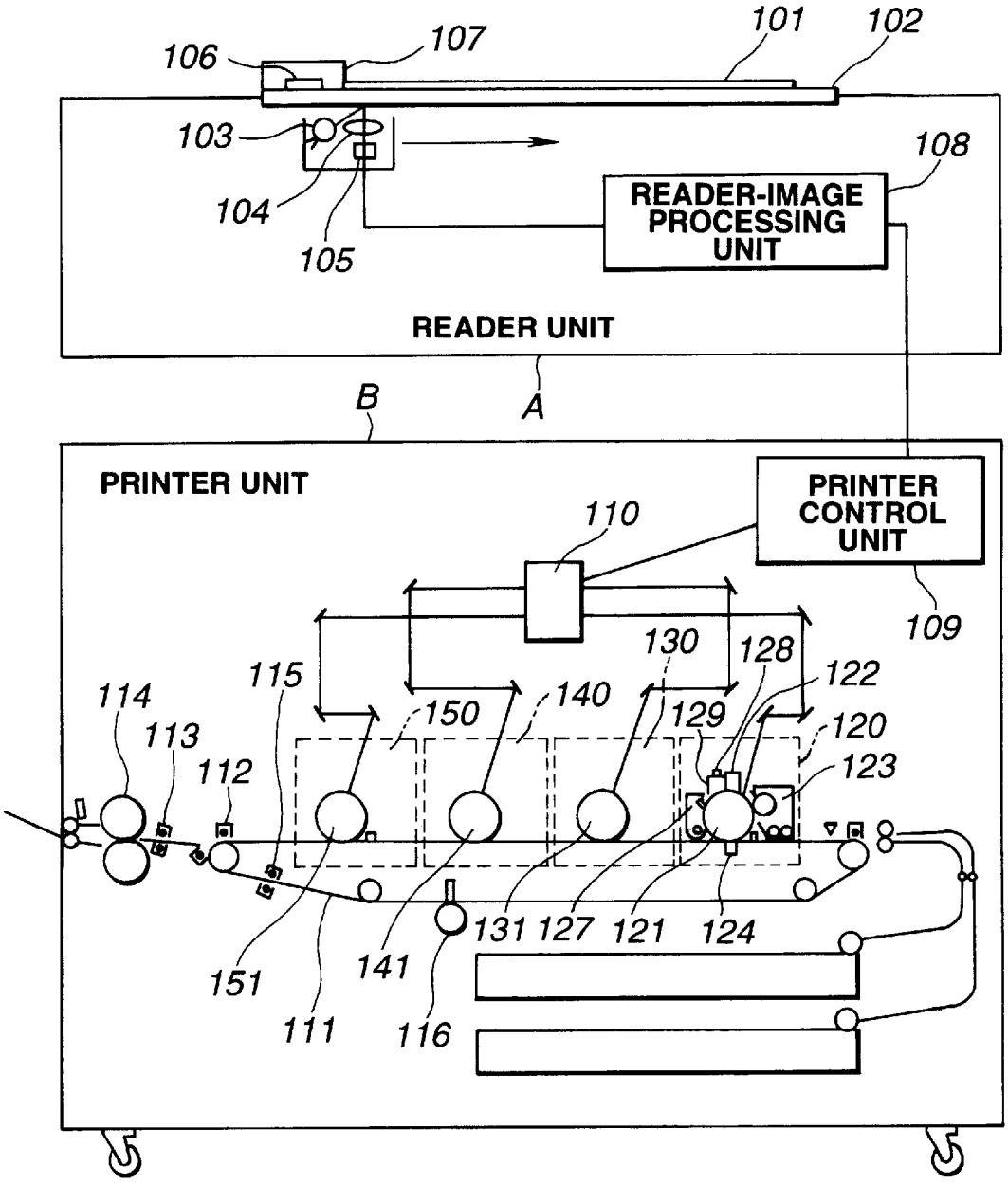
FIG. 1 is a diagram illustrating the configuration of a color copier according to a first embodiment of the present invention.

FIG. 1 is a diagram illustrating the configuration of a color copier according to a first embodiment of the present invention. First, a method for forming a full-color image according to the first embodiment will be described with reference to FIG. 1.

An original 101 mounted on original-mount glass 102 is illuminated by a light source 103. Light reflected from the original 101 is focused on a CCD (charge-coupled device) sensor 105 via an optical system 104. CCD line sensors for red (R), green (G) and blue (B) arranged in three rows of the CCD sensor 105 generate R, G and B color-component signals, respectively. The light source 103, the optical system 104 and the CCD sensor 105 constitute a reading optical system unit, which converts the image of the original 101 into electical signal data strings for respective lines.

A reference white plate 106 for determining a white level of the CCD sensor 105 and performing shading in a thrust direction of the CCD sensor 105 is disposed on the surface of the original-mount glass 102. An image signal obtained from the CCD sensor 105 is subjected to image processing by a reader-image processing unit 108. The resultant signal is transmitted to a printer unit B to be used for providing a laser beam by a printer control unit 109.

Figure 2A:
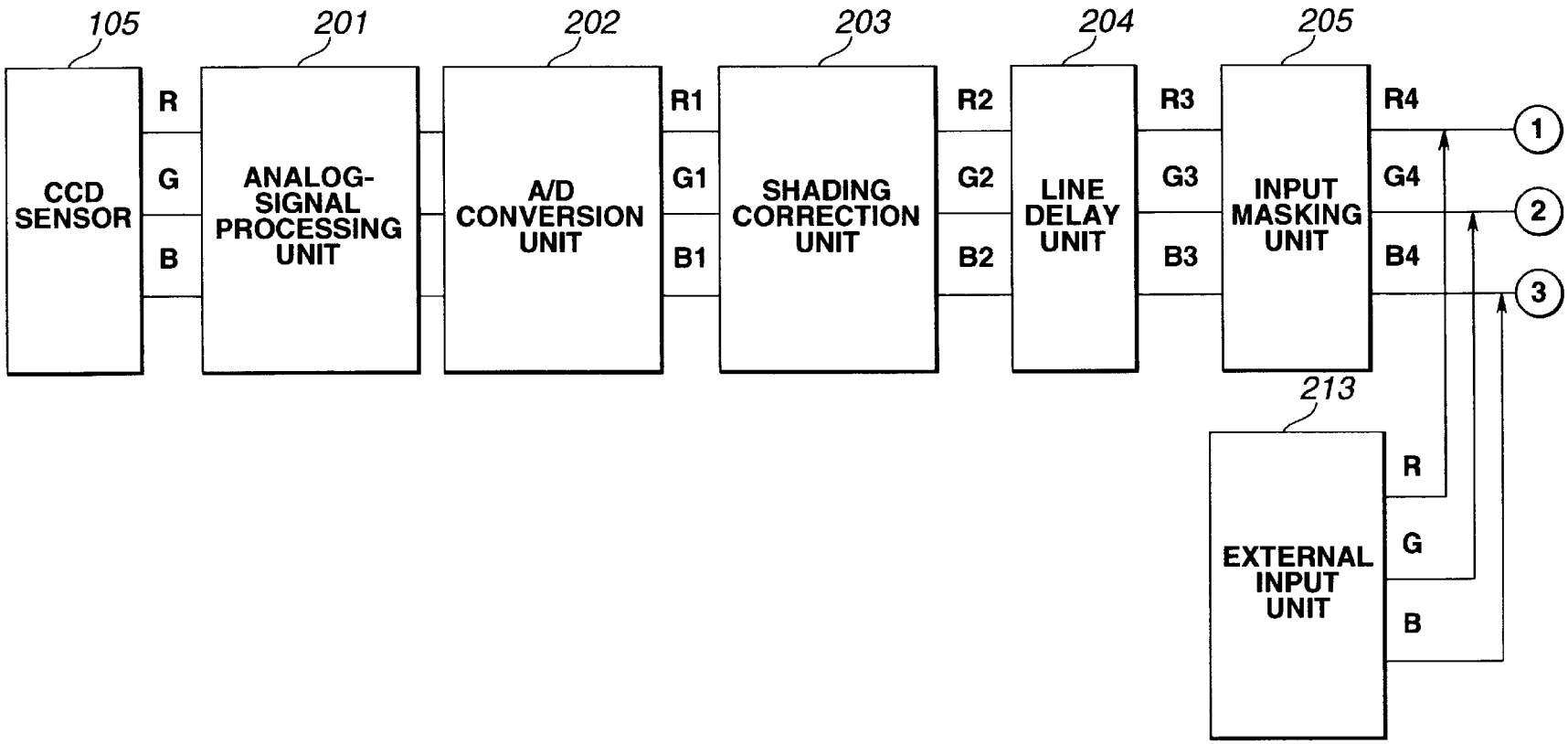
FIGS. 2A and 2B are block diagrams illustrating the flow of an image signal in a reader-image processing unit 108 shown in FIG. 1.
Figure 2B:
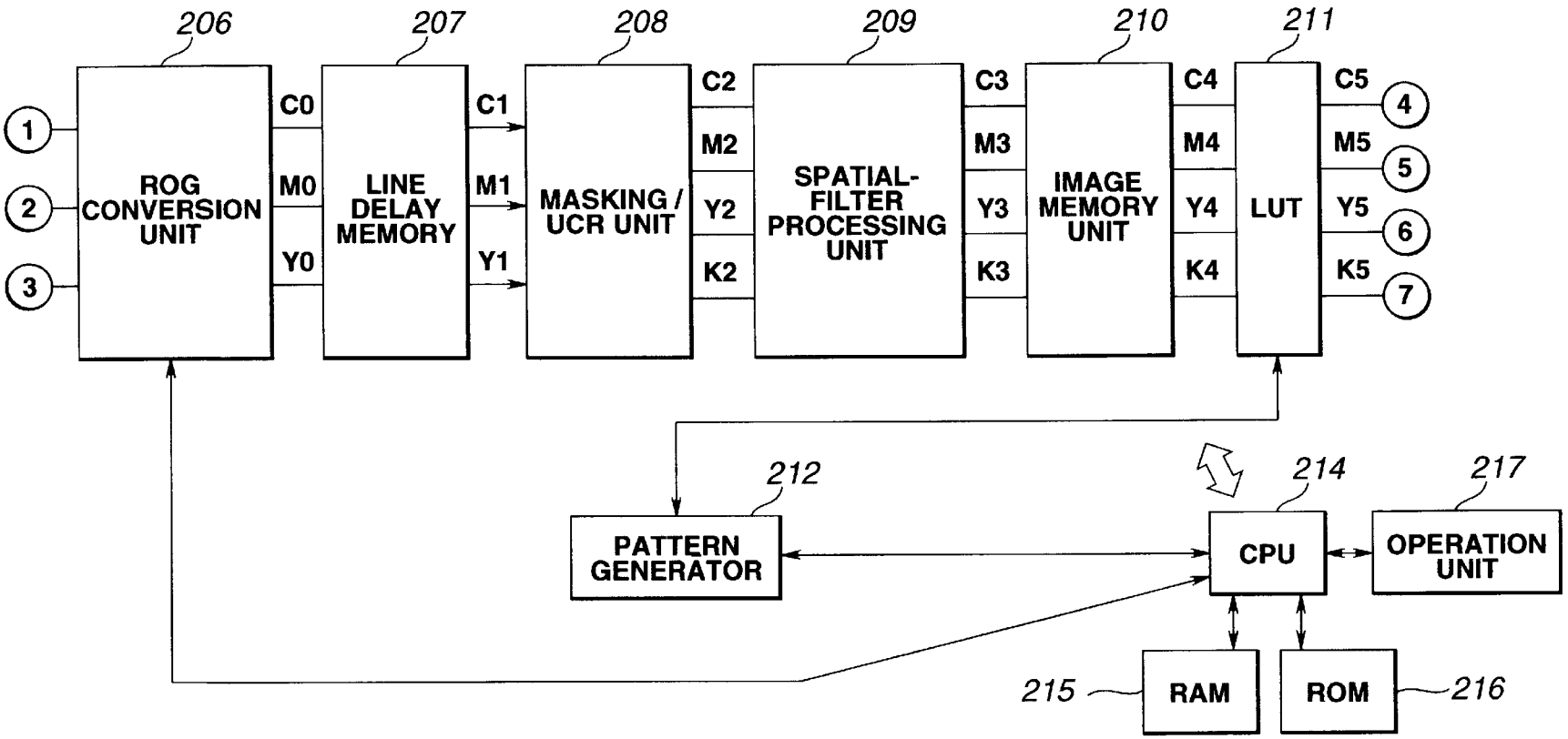

FIGS. 2A and 2B are block diagrams illustrating the flow of the image signal in the reader-image processing unit 108. As shown in FIG. 2A, image signals (R, G and B) output from the CCD sensor 105 are first input to an analog-signal processing unit 201 to be subjected to gain adjustment and offset adjustment. Output signals from the analog-signal processing unit 201 are converted into 8-bit digital image signals (R1, G1 and B1) for respective color signals by an A/D (analog-to-digital) conversion unit 202. The digital image signals (R1, G1 and B1) are input to a shading correction unit 203 to be subjected to known shading correction using reading signals from the reference white plate 106 for respective colors, and image signals (R2, G2 and B2) are output.

A line delay unit 204 controls delay of line data for respective colors in order to correct spatial deviations of respective colors in the CCD sensor 105. That is, since the line sensors for respective colors of the CCD sensor 105 are arranged with a predetermined distance between adjacent line sensors in a sub-scanning direction, the line delay unit 204 corrects spatial deviations of the respective line sensors. Output signals (R3, G3 and B3) from the line delay unit 204 are input to an input masking unit 205.

The input masking unit 205 converts read color space determined by spectral characteristics of R, G and B filters of the CCD sensor 105 into NTSC (National Television System Committee) standard color space, and performs 3×3 matrix calculation. A light-amount-to-density conversion unit (LOG conversion unit) 206 includes a look-up table (LUT) RAM, and converts R4, G4 and B4 luminance signals into Y0, M0 and C0 density signals. A line delay memory 207 stores a predetermined number of line data, and provides the following units with line-delayed data.

A masking/UCR unit 208 extracts a black signal (Bk) from input Y1, M1 and C1 primary-color signals, performs calculation to correct color turbidity of recording color materials in the printer unit B, and sequentially outputs Y2, M2, C2 and K2 signals with a predetermined bit width (8 bits) at every reading operation.

A spatial-filter processing unit (output filter) 209 performs edge emphasis or smoothing processing for the Y2, M2, C2 and K2 signals, and outputs Y3, M3, C3 and K3 signals. An image memory unit 210 temporarily stores the output Y3, M3, C3 and K3 signals, and outputs the stored signals to an LUT 211 in synchronization with image formation by the printer. The LUT 211 performs density correction in a reader unit A so as to be adjusted to ideal gradation characteristics of the printer unit B. Signals (Y5, M5, C5 and K5) output from the LUT 211 are suquentially transmitted to the printer control unit 109. The contents of the LUT 211 can be rewritten by a CPU (central processing unit) 214.

Reference numeral 213 represents an external input unit 213, which, for example, can input R, G and B data from a host computer. As a result, the color copier of the first embodiment also operates as a color printer.

The reader-image processing unit 108 includes a pattern generator 212, a CPU 214, a RAM (random access memory) 215, a ROM (read-only memory) 216, and an operation unit 217. A pattern generator 212 registers patterns for test print, which will be described later with reference to FIGS. 7 and 8, and can directly transmit signals to input addresses for respective colors of the LUT 211.

The CPU 214 executes various kinds of control in accordance with control programs stored in the ROM 216. The RAM 215 provides operational regions when the CPU 214 executes various kinds of processing. The ROM 216 stores various kinds of control programs to be executed by the CPU 214. The user can perform various kinds of settings and processing instructions through the operation unit 217.

Figure 2C:
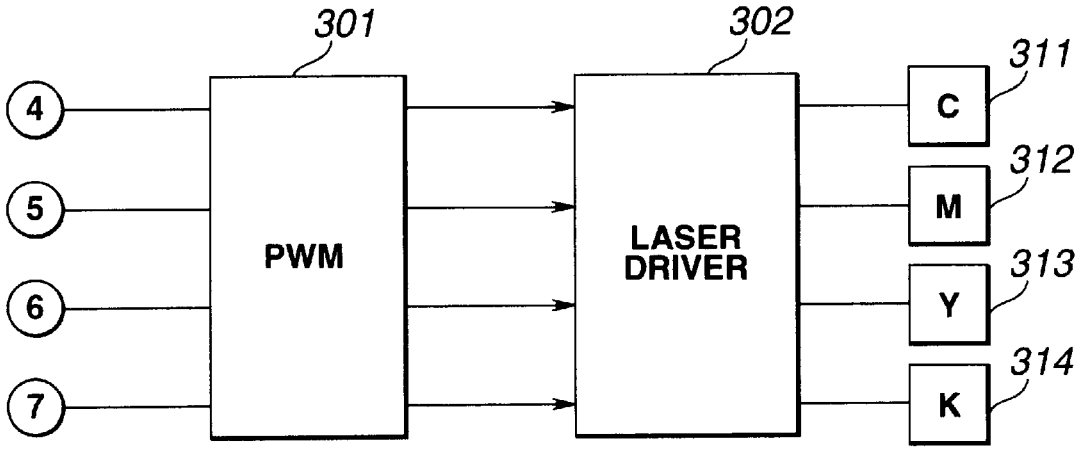
FIG. 2C is a block diagram illustrating the configuration of a printer control unit 109 shown in FIG. 1.

Next, the printer unit B will be described. FIG. 2C is a block diagram illustrating the configuration of the printer control unit 109. In FIG. 2C, a pulse-width modulator (PWM) 301 generates pulses having a signal width based on image signals (C5, M5, Y5 and K5) transmitted to the printer control unit 109. A laser driver 302 generates a laser beam based on the signal subjected to pulse-width modulation by the pulse-width modulator 301.

In FIG. 1, a polygonal scanner 110 scans photosensitive drums 121, 131, 141 and 151 of image forming units 120, 130, 140 and 150, respectively, with the laser beam. Yellow (Y) image forming unit 120, magenta (M) image forming unit 130, cyan (C) image forming unit 140, and black (Bk) image forming unit 150 form images of corresponding colors. Since the image forming units 120, 130, 140 and 150 have substantially the same configuration, the detail of the Y image forming unit 120 will be described, and a description of other image forming units will be omitted. In the Y image forming unit 120, an electrostatic latent image is formed on the surface of a photosensitive drum 121 by the laser beam from the polygonal scanner 110. A primary charger 122 charges the surface of the photosensitive drum 121 to a predetermined potential in order to prepare for forming an electrostatic latent image. A developing unit 123 develops the electrostatic latent image on the photosensitive drum 121 to form a toner image. A transfer blade 124 performs charging from behind a transfer belt 111 to transfer the toner image on the photosensitive drum 121 onto recording paper or the like on the transfer belt 111.

The surface of the photosensitive drum 121 after image transfer is cleaned by a cleaner 127, and any charge remaining on the photosensitive drum 121 is removed by an auxiliary charger 129. Remaining charges are removed by a pre-exposure lamp 128, so that proper charging can be again performed by the primary charger 122.

The recording paper or the like having the toner image transferred thereon is conveyed by the transfer belt 111. Thereafter, toner images of respective colors formed by respective image forming units are sequentially transferred in the order of M, C and Bk to provide a four-color image on the surface of the recording paper or the like. Charges on the recording paper or the like passing through the BK-image forming unit 150 are removed by a charge-removing charger 112 so that the recording paper or the like can be easily separated from the transfer belt 111, and the recording paper or the like is then separated from the transfer belt 111. The separated recording paper or the like is charged by a prefixing charger 113 in order to prevent disturbance in the image by supplementing the toner attracting force, and the toner image is then fixed by a fixing unit 114. Charges on the transfer belt 111 from which the recording paper or the like has been separated are removed by a transfer-belt-charge removing charger 115. The transfer belt 111 is then cleaned by a belt cleaner 116 to again prepare for attracting recording paper or the like.

In the first embodiment, in order to form a full-color image having stable density and gradation, two kinds of image density/gradation control operations, which will be termed first density/gradation control and second density/gradation control, are performed. The first embodiment has a feature in that the second density/gradation control is adjusted based on the result of the first density/gradation control. The image density/gradation control of the first embodiment will now be described.

Figure 3:
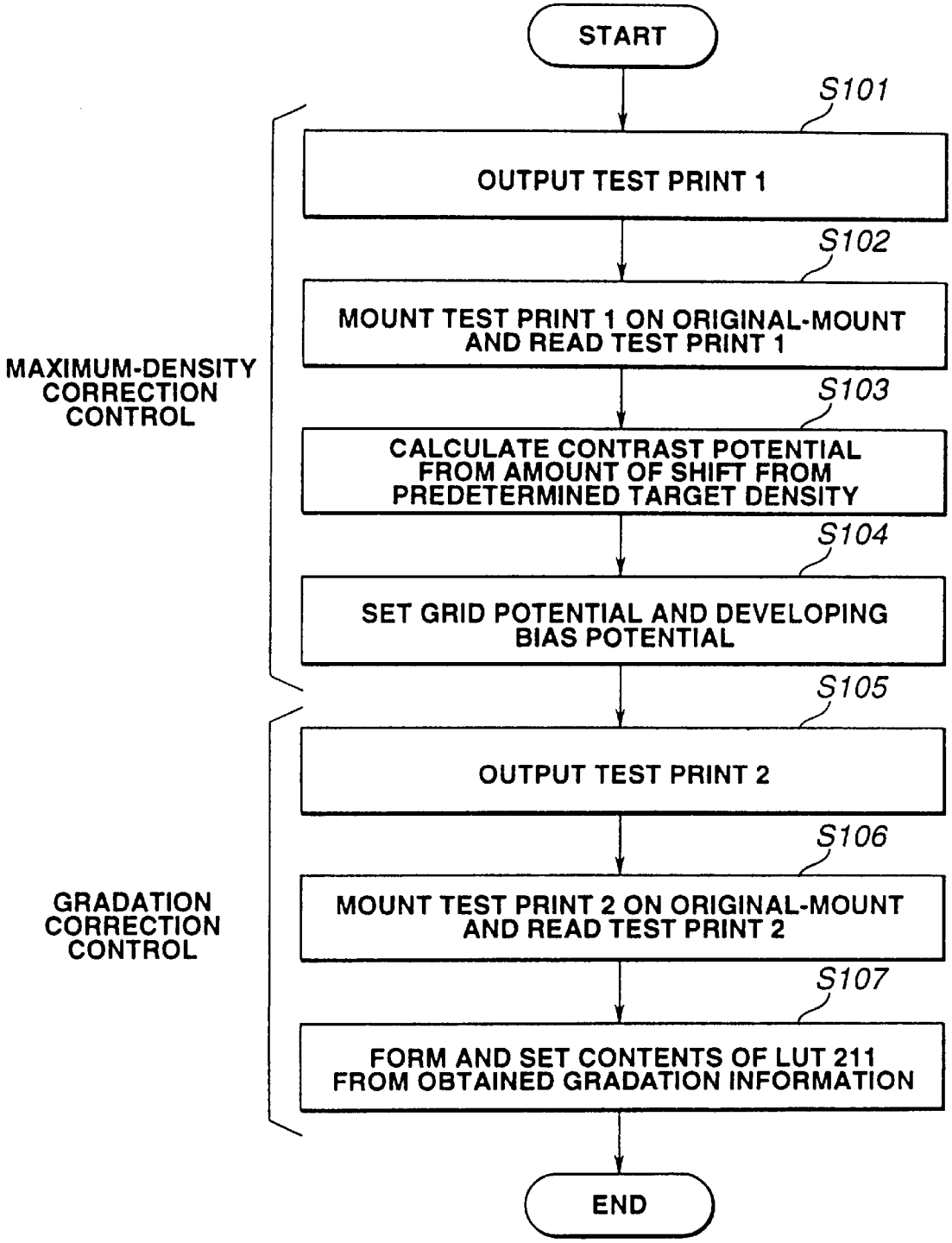
FIG. 3 is a flowchart illustrating procedures in first density/gradation control in the first embodiment.

First, the first density/gradation control will be described. FIG. 3 is a flowchart illustrating procedures of the first density/gradation control according to the first embodiment. A control program for realizing control procedures shown in the flowchart is, for example, stored in the ROM 216 and is executed by the CPU 214.

When the first density/gradation control has been started according to an instruction from the operation unit 217, then, in step S101, a test print 1 is output in accordance with the above-described image forming process. At that time, the CPU 214 determines the presence/absence of a sheet necessary for forming the test print 1, and issues a warning display if the sheet is absent. A potential in a standard state corresponding to environmental conditions of the apparatus is registered and used as an initial value of a contrast potential (to be described later) when forming the image of the test print 1.

Figure 7:
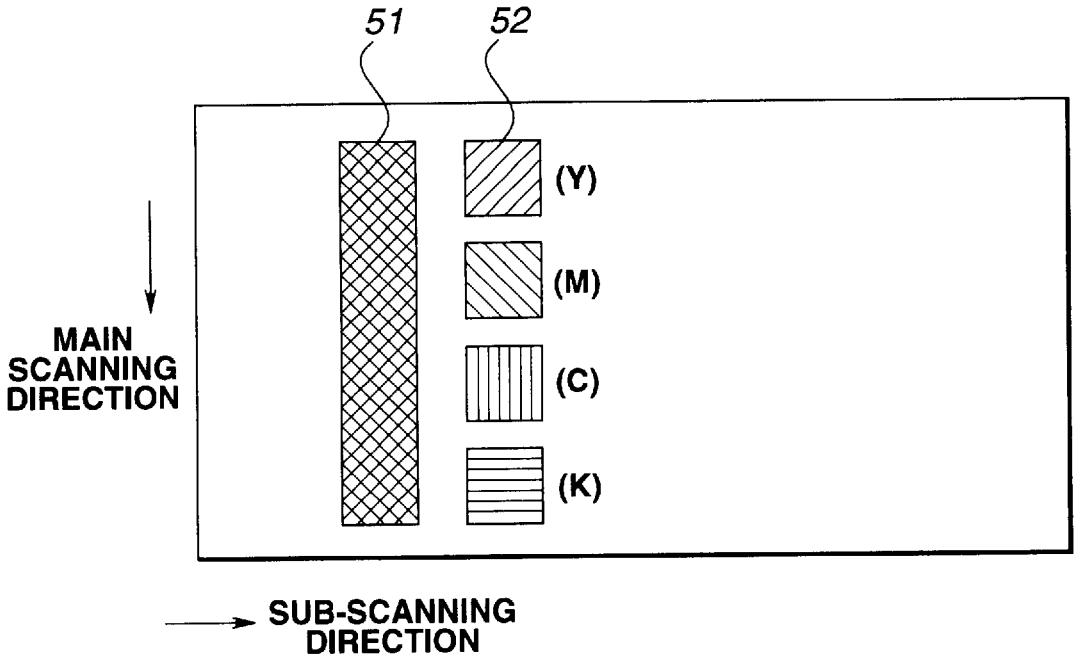
FIG. 7 is a diagram illustrating an example of pattern of a test print 1.

When the CPU 214 has instructed the pattern generator 212 to output a test pattern 1, the pattern generator 212 outputs a test pattern as shown in FIG. 7 to the LUT 211. The contents of the LUT 211 assume a through state in which the output value equals the input value. As shown in FIG. 7, the test pattern 1 includes a belt pattern 51 having an intermediate gradation density for four colors, i.e., Y, M, C and Bk, and a batch pattern 52 including maximum density patches (having a density-signal level of 255) for respective colors Y, M, C and Bk. The belt pattern 51 is used for identifying the position of the patch pattern 52 in the test pattern 1.

Then, the test print 1 output in step S102 is mounted on the original-mount glass 102 and is read. The obtained R, G and B values are converted into optical density values by the LOG conversion unit 206 using an LUT for LOG conversion. Coefficients calculated using the following expression (2) are set in advance in the LUT:

$$C=-kc\times\log10(R/255)$$

$$M=-km\times\log10(G/255)$$

$$Y=-ky\times\log10(B/255)$$

$$Bk=-kb\times\log10(G/255) \quad (2),$$

where correction coefficients (k) are adjusted so as to provide optical density values.

Figure 4:
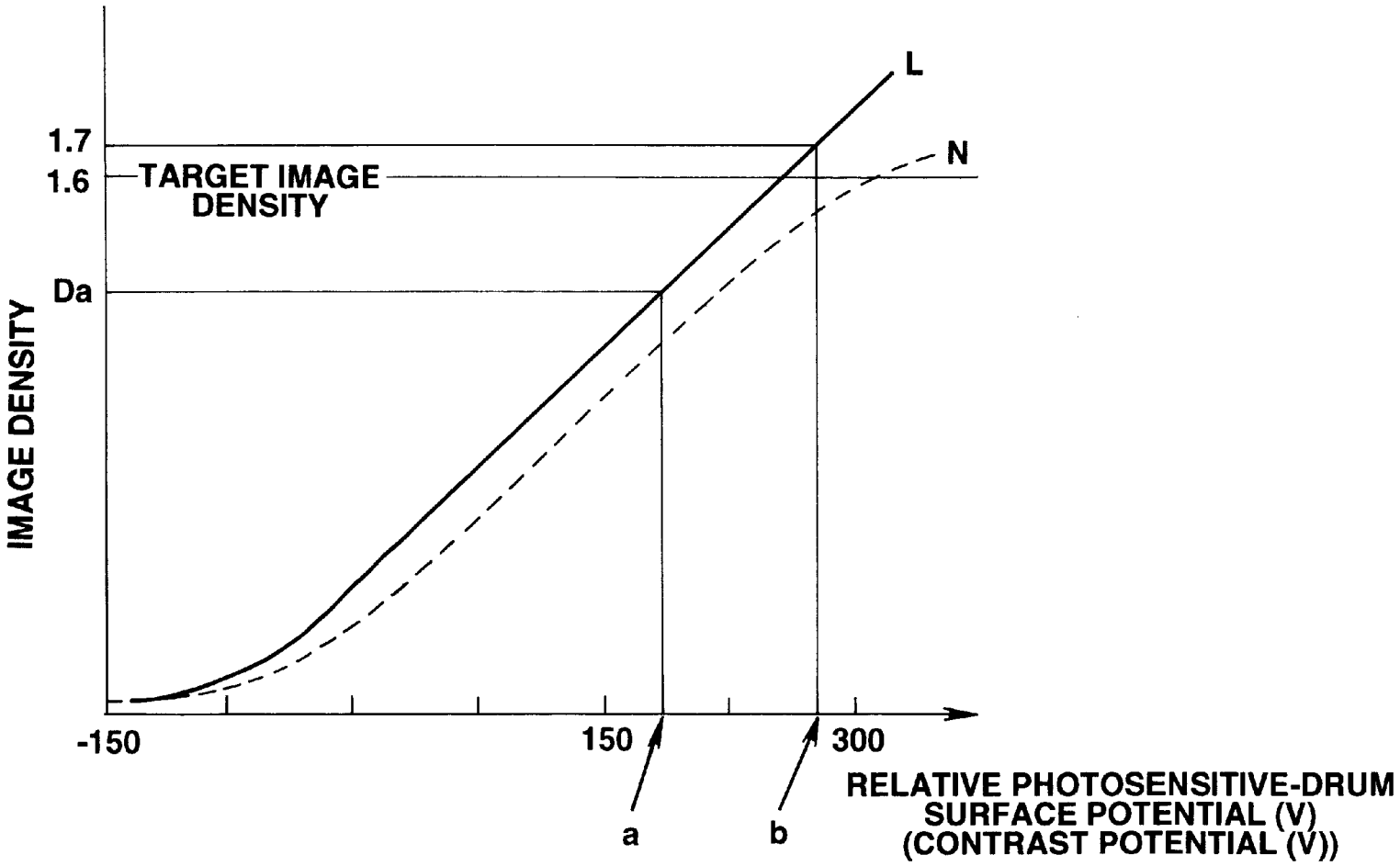
FIG. 4 is a diagram illustrating the relationship between the relative photosensitive-drum surface potential and the image density obtained by calculation shown in FIG. 3.

The density information thus obtained is supplied to the CPU 214. Next, a description will be provided of a method for correcting the maximum density by appropriately setting the contrast potential from the obtained density information (steps S103 and S104). FIG. 4 is a diagram illustrating the relationship between the relative photosensitive-drum surface potential and the image density obtained according to the above-described calculation. The relative photosensitive-drum surface potential is the difference between the developing bias potential and the surface potential of the photosensitive drum after a latent image has been formed.

As shown in FIG. 4, a case is considered in which the contrast potential used when providing the test print 1 (the difference between each of the surface potentials of photosensitive drums 121, 131, 141 and 151 when semiconductor lasers 311, 312, 313 and 314 of respective colors emit light beams having the maximum levels after primary charging, and the developing bias potential) is represented by "a", and the maximum density obtained by this setting is represented by $D_a$. In the density region of the maximum density, the image density changes, in most cases, linearly with respect to the relative photosensitive-drum surface potential as indicated by a solid line L. However, in a twocomponent developing system using a toner and a carrier which constitute a developer, when the toner concentration within the developing unit decreases, a nonlinear characteristic is, in some cases, provided in the density region of the maximum density, as indicated by a broken line N. Accordingly, in the first embodiment, while the final target value of the maximum density is set to 1.6, the target value of the maximum density is set to 1.7 including a margin of 0.1. The contrast potential b for obtaining the above-described maximum density is calculated, and control is performed so as to adjust the contrast potential to b.

In the first embodiment, the contrast potential b is obtained using the following expression (3):

$$b=(a+\mathrm{ka})\times 1.7/D_a \quad (3),$$

where ka is a correction coefficient which is preferably optimized in accordance with the type of the developing method (step S103).

Then, a grid potential and a developing bias potential are set based on the contrast potential b obtained from expression (3). A description will now be provided of a method for determining the "grid potential" which is the potential applied to the grid of the primary charger 122, and the "developing bias voltage" which is the DC component of the voltage applied to the developing sleeve.

Figure 5:
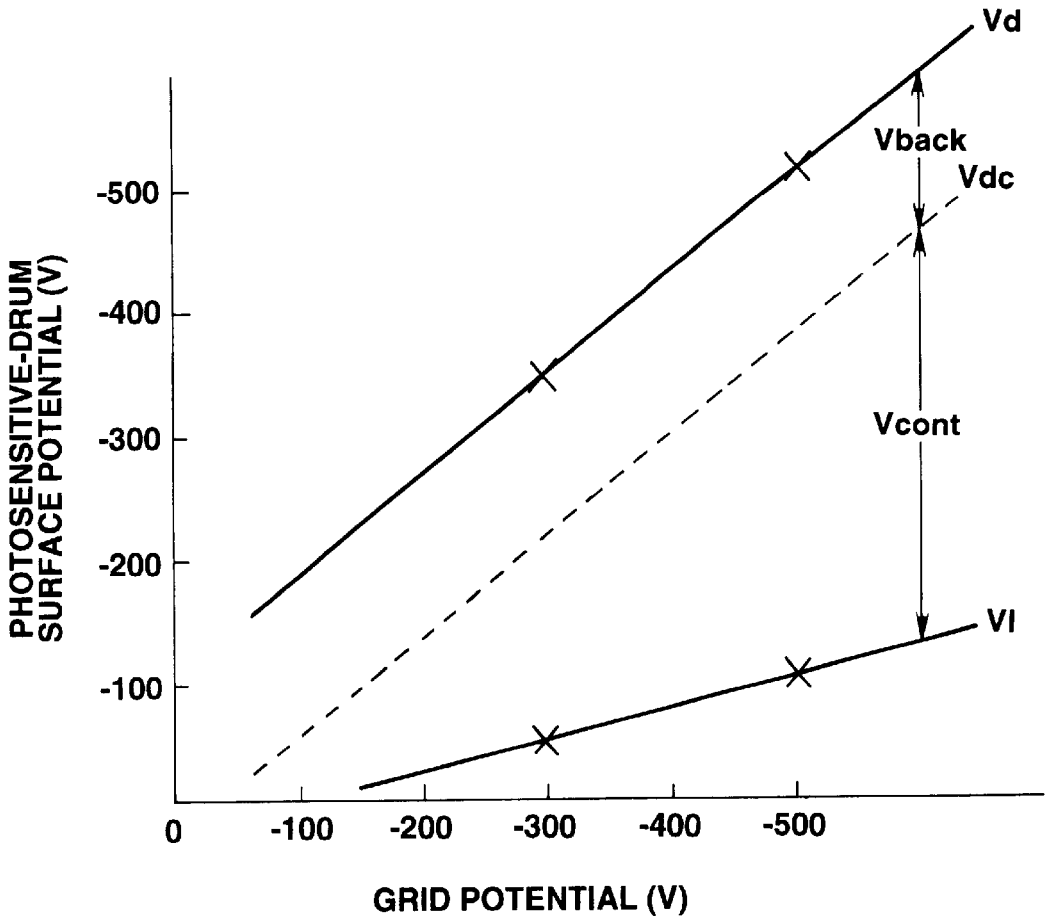
FIG. 5 is a diagram illustrating an example of the relationship between the grid potential and the photosensitive-drum surface potential.

FIG. 5 is a diagram illustrating an example of the relationship between the grid potential and the photosensitive-drum surface potential. In FIG. 5, the results of measurement, performed using a surface electrometer (not shown), of the surface potentials $V_d$ and V1 when scanning is performed by minimizing and maximizing, respectively, the level of emitted pulses of the semiconductor lasers 311, 312, 313 and 314 while setting the grid potential to −300 V and −500 V are indiated by x. By linearly interpolating and extrapolating the values of $V_d$ and V1 at the grid potentials of −300 V and −500 V, it is possible to obtain the relationship between the grid potential and the photosensitive-drum surface potential. Control for obtaining such potential data is called potential measurement control.

The developing bias voltage $V_{dc}$ is set by subtracting a voltage $V_{back}$ (set to 150 V in this case) set so as to prevent adhesion of fogging toner particles on the image from the surface potential $V_d$. The contrast potential Vcont is the difference potential between the developing bias voltage $V_{dc}$ and the surface potential V1. As described above, as the value of the voltage $V_{cont}$ is larger, the maximum density becomes larger.

It is apparent that the values of the grid potential and the bias developing potential for providing the contrast voltage b obtained by the above-described expression (3) can be calculated from the relationship shown in FIG. 5.

The grid potential and the developing bias potential ($V_{dc}$) so as to realize $V_{cont}$=b are obtained in the above described manner. As a result, the contrast potential b is obtained so as to increase the maximum density by 0.1 from the final target value, and the grid potential and the developing bias potential are set so as to provide the contrast potential b (step S104).

Next, gradation correction control for optimizing the LUT 211 (steps S105–S107) is executed. A description will now be provided of the role of the LUT 211 and the gradation correction control.

Figure 6:
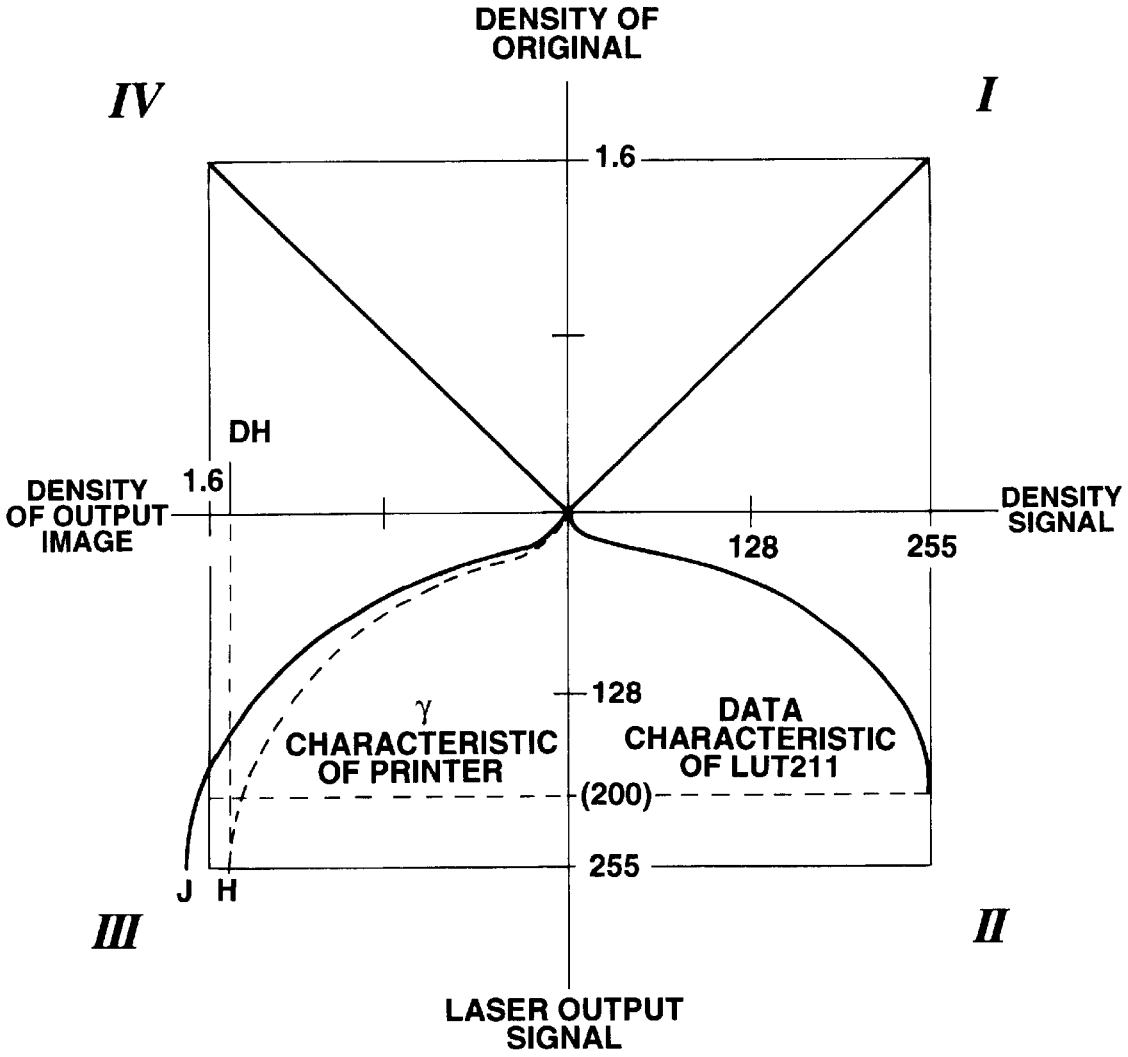
FIG. 6 is a characteristics conversion chart illustrating characteristics of reproduction of the density of an image of an original.

FIG. 6 is a characteristics conversion chart indicating characteristics for reproducing the density of the image of the original. In FIG. 6, region I indicates the characteristic of the image reading device for converting the density of the original into a density signal, and region II indicates the characteristic of the LUT 211 for converting the density signal into a laser output signal. Regions III indicates the characteristic of a printer for converting the laser output signal into the output density. Regions IV indicates the relationship between the density of the original and the recording density. This characteristic represents the total gradation characteristic in the copier of the first embodiment.

In this case, since a digital signal comprises 8 bits, the number of gradation levels is 256. According to maximum density control in which the maximum density is set to a value higher than the final target value, the characteristic of the printer in the region III has a shape as indicated by a solid line J. If such control is not performed, the characteristic of the printer may have a shape as indicated by a broken line H which does not reach the target density 1.6. Since the LUT 211 does not have the capability of increasing the maximum density, density values between the density DH and 1.6 cannot be reproduced no matter how the LUT is set for the printer characteristic of the broken line H.

In this image forming apparatus, in order to provide a linear gradation characteristic in region IV, the curved portion of the recording characteristic of the printer in region III is corrected by the LUT 211. The LUT 211 can be formed by reversing the relationship between input and output in region III. A description will now be provided of optimizing procedures of the LUT 211.

Figure 8:
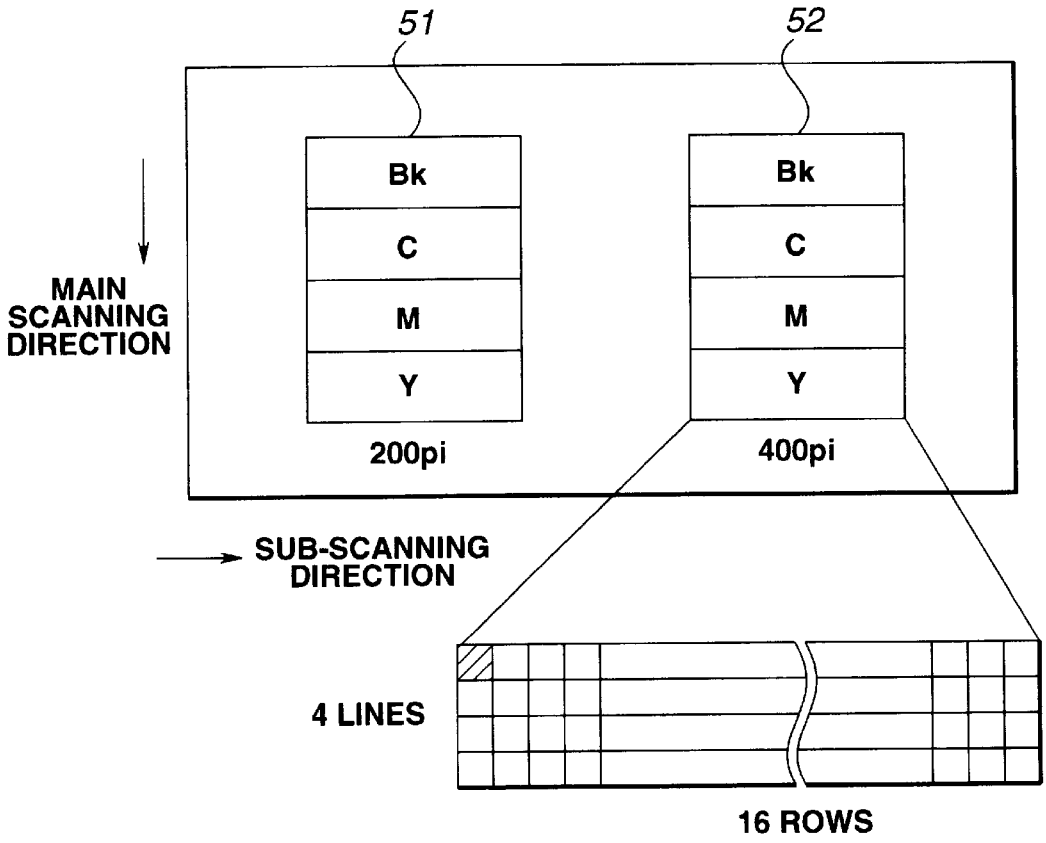
FIG. 8 is a diagram illustrating an example of pattern of a test print 2.

First, a test print 2 is output (step S105). When outputting the test print 2, image formation is performed without operating the LUT 211. This can be realized, for example, by providing a signal line which makes the LUT 211 to be through, or by rewriting the contents of the LUT 211 to γ=1. FIG. 8 illustrates an example of the pattern of the test print 2. As shown in FIG. 8, the test print 2 consists of patches of 64 gradation levels in total, comprising 16 rows for each of 4 lines for Y, M, C and BK. Low-density regions from among 256 gradation levels in total are preferentially allocated to the 64 gradation levels. It is thereby possible to satisfactorily adjust gradation characteristics in a highlight portion. In FIG. 8, reference numeral 61 represents a patch having a resolution of 200 lps (lines/inch), and reference numeral 62 represents a patch having a resolution of 400 lps. An image of each resolution value can be formed by providing a triangular wave used for comparison with image data to be processed with a plurality of periods in the pulse-width modulator 301. In this image forming apparatus, a gradation image is formed with a resolution of 200 lps, and a line image including characters or the like is formed with a resolution of 400 lps. A pattern of the same gradation level is output with these two kinds of resolution values. However, if gradation characteristics greatly differ depending on the resolution value, it is preferable to set the above-described 64 gradation levels in accordance with the resolution value.

The output test print 2 is read by the reader unit A according to the same procedures as in the above-described maximum density correction control, and density data for each gradation level is obtained. The density values thus obtained by being read by the reader unit A are written in the RAM 215 so as to correspond to laser output levels in accordance with the formed position of each gradation pattern and the laser output level of each gradation (step S106).

In this stage, the characteristic of the printer shown in the region III in FIG. 6 can be obtained, and by reversing the relationship between input and output of the characteristic of the printer, the LUT 211 for the printer can be determined. The obtained result is set as the LUT 211 (step S107). When obtaining the LUT 211 by calculation, only data whose number equals the number of gradation patterns of the patch pattern are present. Accordingly, data between discrete points are generated by performing interpolation so as to provide laser output levels corresponding to all levels between 0 and 255 of the density signal.

According to the above-described first density gradation control, a contrast potential for providing an appropriate maximum density value and an LUT for providing an appropriate gradation characteristic are set. A description will now be provided of the second density gradation control. In the second density gradation control in the first embodiment, the density of the reproduced image is maintained by appropriately providing the concentration of the developer. The second density gradation control of the first embodiment will now be described in detail illustrating a case of yellow (Y).

Figure 9:
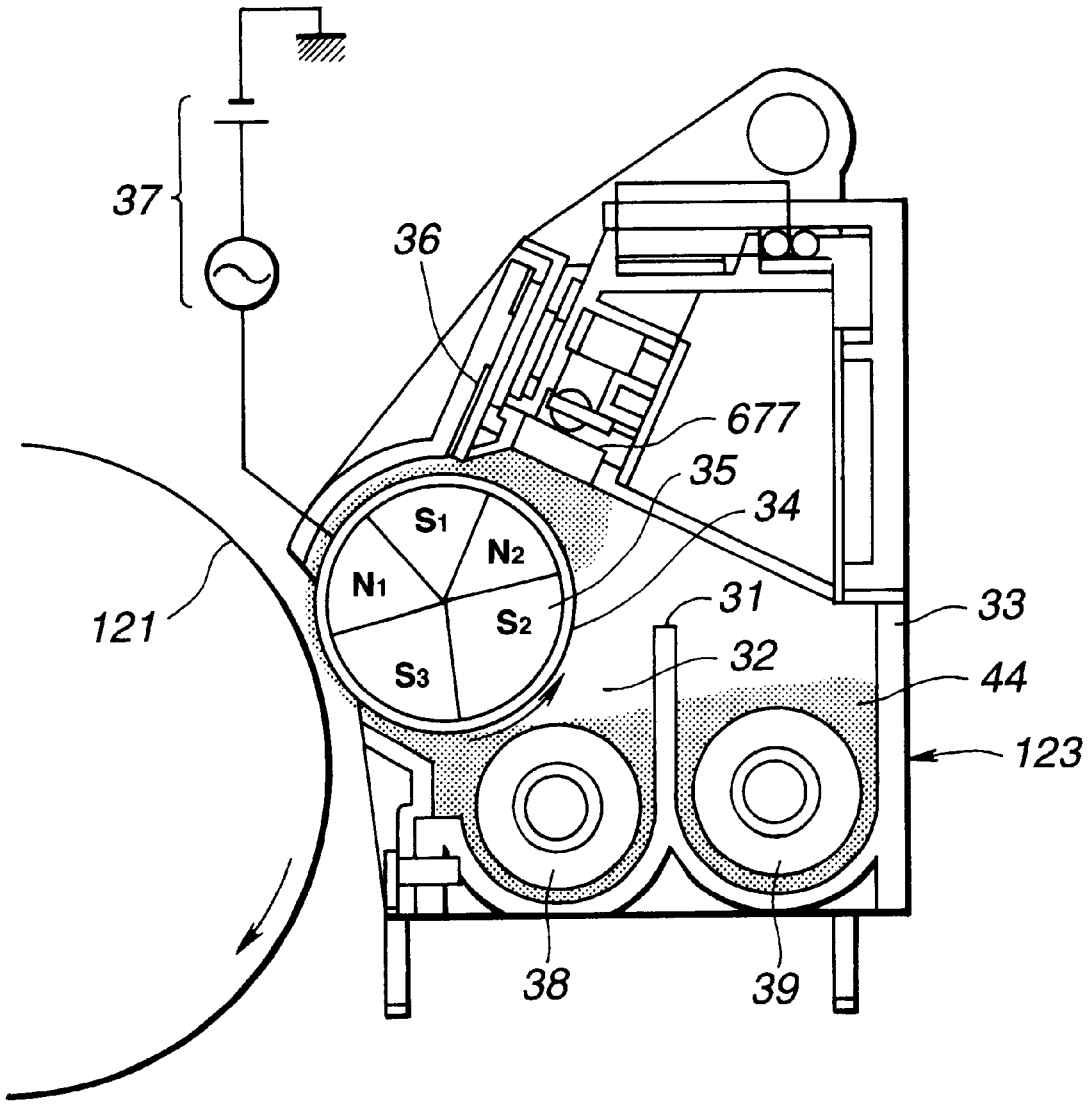
FIG. 9 is a diagram illustrating the detailed configuration of a developing unit 123 for yellow shown in FIG. 1.
Figure 10:
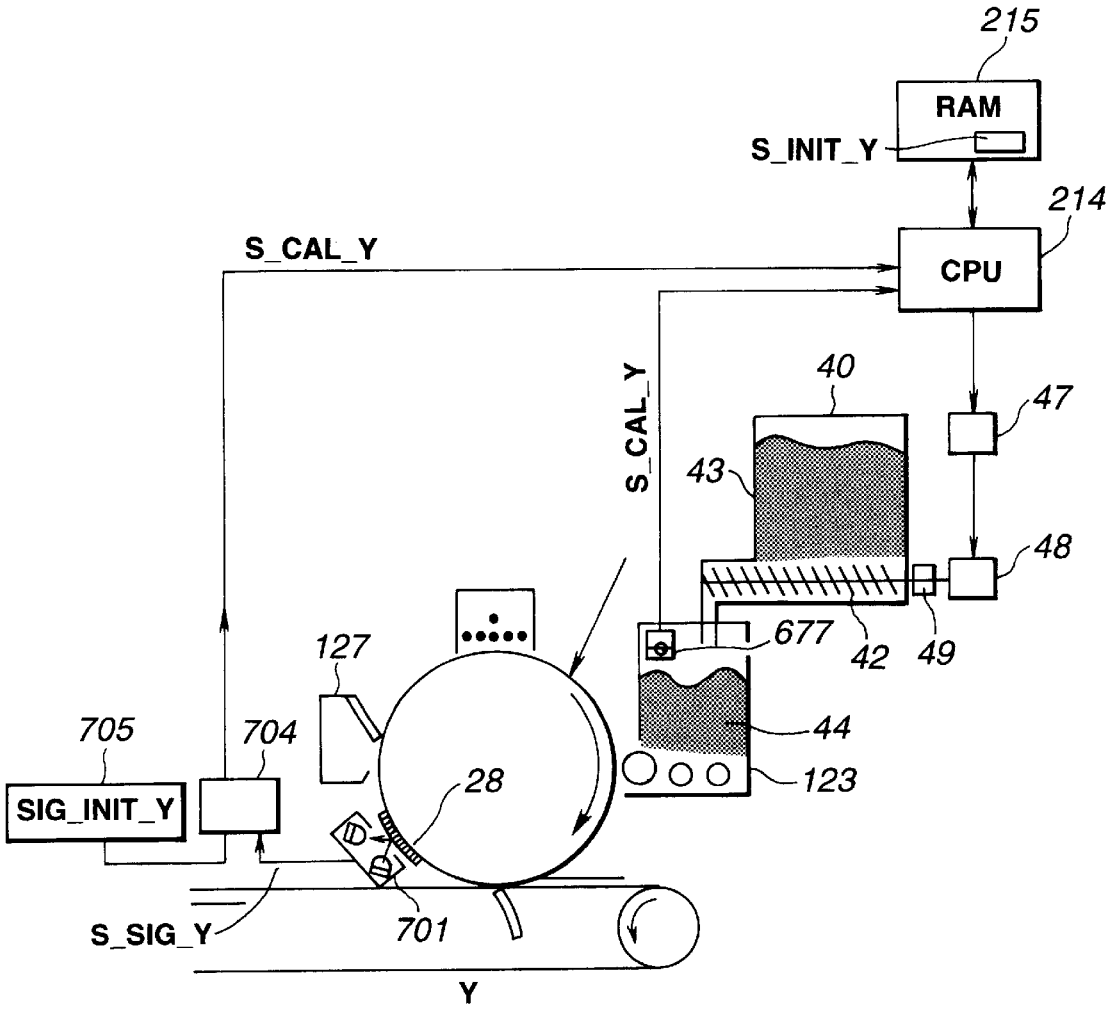
FIG. 10 is a diagram illustrating an outline of second density/gradation control in the first embodiment.

FIG. 9 is a diagram illustrating the detailed configuration of the developing unit 123 for yellow in the first embodiment. FIG. 10 is a diagram illustrating an outline of the second density gradation control of the first embodiment.

As shown in FIG. 9, the developing unit 123 is disposed so as to face the photosensitive drum 121, and the inside of the developing unit 123 is divided into a first chamber (developing chamber) 32 and a second chamber (stirring chamber) 33 by a partition 31 extenting in the vertical direction. A nonmagnetic developing sleeve 34 rotating in the direction of the arrow is disposed within the first chamber 32, and a magnet 35 is fixed within the developing sleeve 34.

As shown in FIG. 10, a toner replenishing tank 40 accommodating a toner for replenishment 43 is mounted above the developing unit 123, and a toner conveying screw 42 is disposed at a lower portion of the toner replenishing tank 40. By rotatably driving the toner conveying screw 42 by a motor 48 connected thereto via a gear train 49, the toner 43 within the replenishing tank 40 is conveyed and supplied into the developing unit 123. The supply and the amount of supply of the toner 43 by the conveying screw 42 are controlled by controlling the revolution of the motor 48 by the CPU 214 via a motor driving circuit 47. Control data and the like to be supplied to the motor driving circuit 47 are stored in the RAM 215 connected to the CPU 214.

Returning to FIG. 9, developer stirring screws 38 and 39 are disposed within the first chamber 32 and the second chamber 33, respectively. The screw 38 stirs and conveys the developer within the first chamber 32. The screw 39 stirs and conveys the toner 43 supplied by the rotation of the conveying screw 42 from the toner replenishing tank 40 (see FIG. 10), and a developer 44 which is already present within the developing unit 123, to homogenize the toner concentration of the developer 44. Developer paths (not shown) to make the first chamber 32 and the second chamber 33 to communicate with each other are formed at front and rear end portions of the partition 31 as seen from the plane of FIG. 9, so that the developer within the first chamber 32 where the toner concentration has decreased due to the consumption of the toner moves into the second chamber 33 from one of the paths and the developer whose toner concentration has recovered within the second chamber 33 moves into the first chamber 32 from the other path by the conveying forces of the screws 38 and 39.

The two-component developer 44 within the developing unit 123 is held on the developing sleeve 34 by the magnetic force of the magnet 35, and is conveyed to a developing region facing the photosensitive drum 121 in accordance with the rotation of the developing sleeve 34 in a state in which the thickness of the layer of the developer 44 is regulated by a blade 36. The developer 44 is used for developing the latent image on the photosensitive drum 121 at the developing region. In order to improve the developing efficiency, i.e., the ratio of adhesion of the toner to the latent image, a developing bias voltage obtained by superimposing a DC voltage on an AC voltage is applied from a power supply 37 to the developing sleeve 34.

The developing property is degraded due to a decrease in the toner concentration of the developer 44 within the developing unit 123 as a result of operations of developing latent images. The developing property also changes due to a change in the surrounding environment, repetition of the developing process, and the like, thereby causing changes in the density and gradation of the obtained image.

In the first embodiment, in order to prevent changes in the density and gradation of the obtained image and perform stable control, the second density/gradation control is performed. In this control, a test pattern is formed on the photosensitive drum 121, the density of the formed image is detected by an image-density sensor 701 provided so as to face the photosensitive drum 121, and the concentration of the developer 44 is controlled based on the detected density (an image-density detection control method). The image-density sensor 701 includes an LED (light-emitting diode), serving as a light-emitting unit, and a photodiode, serving as a photosensing unit. This image-density detection control method is applied to all of four colors, i.e., Y, M, C and K. For forming an image of three chromatic colors, i.e., yellow, magenta and cyan, a method for controlling the concentration of the developer 44 by providing a toner-concentration sensor 677 in each developing unit, and detecting the toner density of the developer 44 within the developing unit 123 (optical developer-concentration detection control) is also adopted. The toner-concentration sensor 677 includes an LED, serving as a light-emitting unit, and a photodiode, serving as a photosensing unit.

In the first embodiment, in the chromatic-color developing process, i.e., in image formation of Y, M and C, a signal output by the image-density detection control is used for correction in the optical developer-concentration detection control. A description will now be provided of a method of correction in the optical developer-concentration detection control illustrating a case of yellow.

Figure 11:
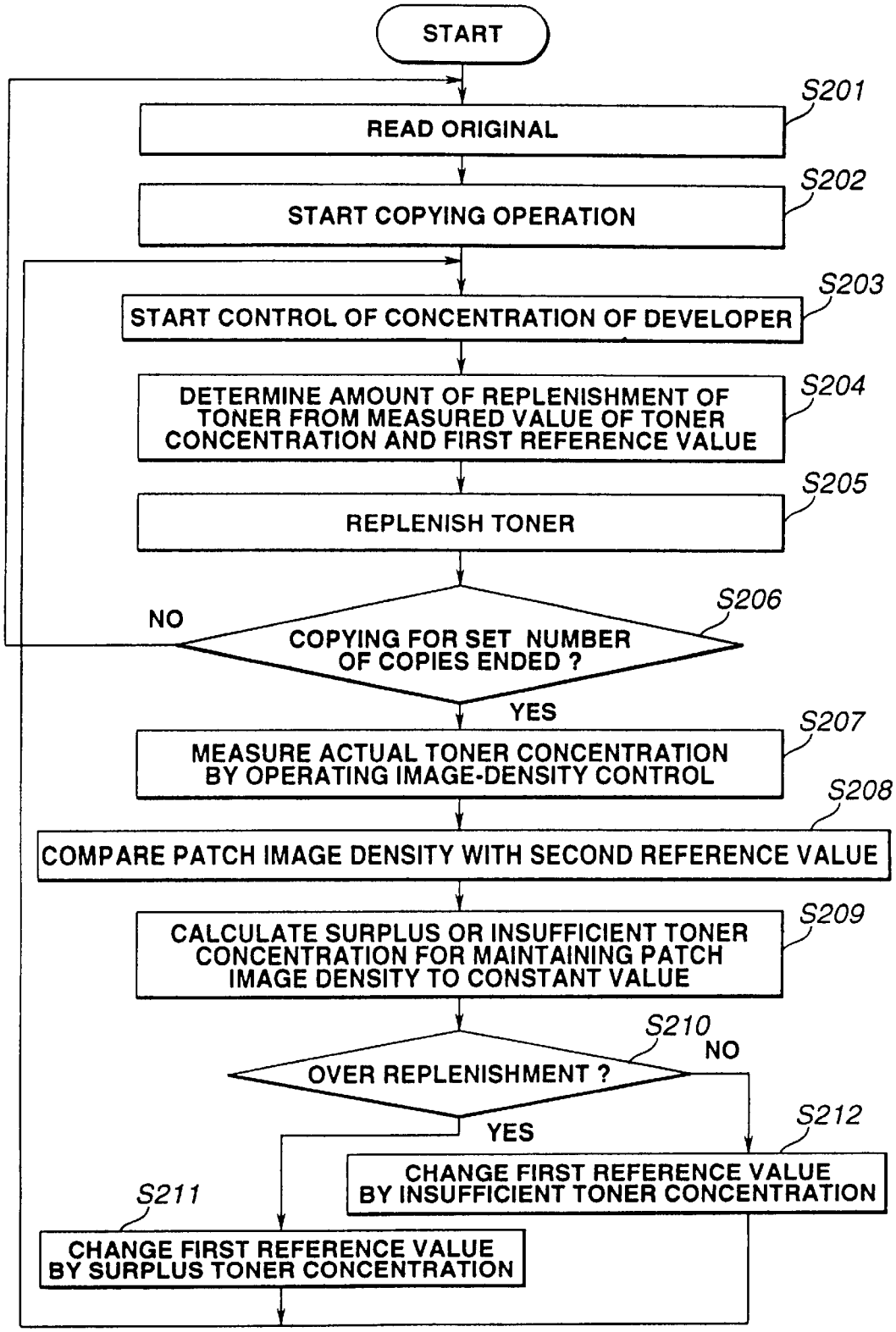
FIG. 11 is a flowchart illustrating procedures of second density/gradation control in the first embodiment.

As described above, the toner-concentration sensor 677, which includes the LED, serving as the light-emitting unit, and the photodiode, serving as the photosensing unit, is provided within the developing unit 123. The toner-concentration sensor 677 detects the concentration of the developer using the characteristics that the toner within the two-component developer reflects infrared rays and the carrier absorbs infrared rays. That is, infrared rays from the LED are projected onto the developer 44 within the developing unit 123, and the amount of reflected infrared rays is detected by the photodiode. The image density is controlled by calculating the toner concentration of the developer 44 based on the detected amount of reflection and controlling the replenishment of the toner. Since the toner-concentration sensor 677 detects the compositional ratio of the toner to the carrier, changes in the concentration of the toner itself cannot be dealt with only by the control by the toner-concentration sensor 677. Hence, it is necessary to adjust the target value of the compositional ratio by the image-density detection control. Such adjustment will now be described in detail with reference to FIGS. 10 and 11. FIG. 11 is a flowchart illustrating procedures of the second density/gradation control in the first embodiment.

The developer 44 is supplied into the developing unit 123, and an output SIG_INIT_Y from the photodiode which detects the amount of reflected light from the developer 44 in an unused state is measured, and the obtained value is stored in the RAM 215 as a first reference value. Then, when a copying process is started and the use of the developer 44 is started (steps S201 and S202), the control of the concentration of the developer 44 is started at every image copying operation (step S203). An output SIG_CAL_Y from the toner-concentration sensor 677 at that time is measured, and the difference ΔSIG_Y from the first reference value (SIG_INIT_Y) stored in the RAM 215 is calculated.

ΔSIG_Y is expressed by:

$$\Delta SIG_Y=(SIG_INIT_Y)-(SIG_CAL_Y) \quad (4),$$

and the amount of shift ΔD from the initial toner-concentration at that time is calculated from expression (4) and a premesured output sensitivity value RATE per 1 wt % variation of the toner density:

$$\Delta D=\Delta SIG_Y/RATE \quad (5).$$

From the calculated value of ΔD, the amount of the toner to be replenished within the developing unit 123 is determined (step S204). That is, if the amount of shift of the toner density from the initial value is minus, the toner whose amount is equal to the amount of shift is replenished. If the amount of shift is plus, the replenishment of the toner is stopped. For example, if ΔD=−1 wt %, the toner corresponding to 1 wt % is replenished. If ΔD=+1 wt %, the toner is not replenished. Thus, control so as to maintain the initial toner concentration is performed.

Next, a description will be provided of image-density detection control. The image-density detection control is operated at a predetermined timing. In the first embodiment, the control is executed after executing copying operations for a predetermined number of copies (step S206).

When it has been determined in step S206 that copying for a set number of copies has been executed, the process proceeeds to step S207, where image-density control is started, and a patch image is formed on the photosensitive drum 121 as a reference image for density detection. The patch image is formed by generating a patch-image signal having a signal level corresponding to a preset density from the pattern generator 212, and supplying the generated patch-image signal to the pulse-width modulation circuit 301 via the LUT 211. Laser driving pulses having a pulse width corresponding to a predetermined density value are generated from the laser driver 302. The laser driving pulses are supplied to a semiconductor laser for Y 313, and the photosensitive drum 121 is scanned with a light beam emitted from the semiconductor laser 313 for time periods corresponding to the pulse width. Thus, a patch electrostatic latent image corresponding to the predetermined density is formed on the photosensitive drum 121, and is developed by the developing unit 123. The contents of the LUT 211 at that time are set in the first density gradation control (based on the formation of patches on the recording paper).

The density value of the patch image is set to a value so that the developing characteristic shown in FIG. 4 can be most easily controlled (a value so that the developing characteristic can be assuredly controlled based on the patch). For example, 128th and 50th levels from among 256 levels are used for chromatic colors and black, respectively. It is thereby possible to control not only the density but also the gradation of the image to desired characteristics according to the following control.

Light from the LED, serving as the light-emitting unit, of the image-density sensor 710 is projected onto the patch image (toner image) on the photosensitive drum 121 which has been obtained in the above-described manner, and the reflected light is received by the photodiode, serving as the photosensing unit, to detect the actual image density of the patch image. The detected patch image density corresponds to the toner concentration of the developer 44 within the developing unit 123.

An output signal S_SIG_Y obtained by detecting the actual patch-image density by the photodiode is supplied to one of inputs of a comparator 704. A reference signal (a second reference value) S_INIT_Y corresponding to a specified density (initial density) of the patch image is input from a reference-voltage signal source 705 to another input of the comparator 704. The comparator 704 compares the patch-image density with the second reference value to provide the density difference, and supplies the CPU 214 with an output signal S_CAL_Y representing the density difference (step S208). This signal S_CAL_Y representing the density difference is used for the correction of the control of toner replenishment into the developing unit 123 in the above-described optical developer-concentration detection control. Although the reference-voltage signal source 705 is used in this embodiment, the signal S_INIT_Y may be stored in the RAM 215, and the density-difference signal S_CAL_Y may be obtained by the CPU 214.

In general, as the toner concentration of the developer is higher, the image density becomes higher, and as the toner concentration of the developer is lower, the image density becomes lower. Furthermore, the developing efficiency changes due to a change in environment, the use for a long time period, or the like. Accordingly, a constant image density cannot be guaranteed only by the optical developer-concentration detection control. Hence, in the first embodiment, a target value SIG_INIT_Y for the optical developer-concentration detection control ia adjusted based on the output signal S_CAL_Y representing the density difference output in the image-density detection control.

That is, the CPU 214 calculates a surplus or insufficient toner concentration for maintaining the patch image density constant based on the output signal S_CAL_Y representing the density difference (step S209). When it has been determined that the supply of the toner in the developer-concentration control is excessive, the process proceeds from step S210 to step S211, where the first reference value (SIG_INIT_Y) within the RAM 215 is reduced by the surplus toner concentration. On the other hand, when it has been determined that the supply of the toner in the developer-concentration control is insufficient, the process proceeds from step S210 to step S212, where the first reference vaule is increased by the insufficient toner concentration.

For example, suppose that the initial toner concentration of the developer 44 is 6 wt %, and that as a result of the developer-concentration detection control in a state in which the toner concentration is controlled to be 6 wt %, the image density has decreased from the initial value, and it is calculated that it is necessary to increase the toner concentration by 1 wt % in order to return the image density to the initial value from a preset correlation between the patch image density and the toner concentration. Based on this result, the target value for the developer-concentration detection control is changed from 6 wt % to a new target value (SIG_TGT_Y) of 7 wt %. The developer-concentration detection control is thereafter performed with this net target value. It is thereby possible to maintain the image density to a desired value.

By controlling the concentration of the toner of the developer to a target value and correcting the target value of the toner concentration depending on the density of the reference patch image on the photosensitive drum using the second density/gradation control, it is possible to prevent changes in the developing characteristics and to stably maintain the density and gradation of the formed image.

However, the density and gradation of the formed image change not only depending on the developing properties but also depending on various factors, such as changes in the photodecay characteristics of the photosensitive drum, changes in the intensity of the photosensing beam, changes in the mechanical accuracy of the apparatus, changes in the intensity of the exposing beam, and the like. It is impossible to absorve these changes and to stably maintain the density and gradation of the image only by the second density/gradation control. Although these changes can be corrected by the first density/gradation control, conditions in the second density/gradation control change at that time. As a result, desired control properties cannot be obtained, and correction realized by the first density/gradation control is inversely controlled toward the state before the correction by the second density/gradation control.

In the first embodiment, in order to effectively apply the first density/gradation control and the second density/gradation control, the second density/gradation control is adjusted based on the result of the first density/gradation control. Such adjustment will now be more specifically described illustrating a case of Y.

In the above-described image density detection control, the patch image is output with a predetermined optimum density in order to guarantee gradation. That is, the patch image signal from the pattern generator 212 is transmitted to the LUT 211 to be subjected to γ conversion so that a desired image is obtained, and then the image is formed on the photosensitive drum in the above-described manner.

As described above, the LUT 211 is appropriately changed by performing the first density/gradation control. Accordingly, the patch density formed on the photosensitive drum is adjusted to an optimum density by performing the first density/gradation control.

Accordingly, when performing the first density/gradation control, a patch image is formed using a newly set LUT 211, and a density-difference output signal S_CAL_Y obtained from the detected image density S_SIG_Y and the reference value S_INIT_Y is stored in the RAM 215 as a reference-value correction value S_ADJ_Y. Thereafter, image-density detection control is performed using a new correction reference signal S_AINT ___Y obtained by adding/subtracting the correction value S_ADJ_Y to/from the reference value S_INIT_Y as a target density value. It is thereby possible to maintain the desired image density and the optimum gradation characteristic corrected by the first image density/gradation control using the image-density detection control.

When the first density/gradation control is performed, the toner concentration of the developer 44 is in the course of being controlled, and therefore, in most cases, does not converge to the target value SIG_INIT_Y (SIG_TGT_Y) set by the image density detection control. In the first embodiment, after setting appropriate contrast potential and LUT by performing the first control, the toner concentration SIG_CAL_Y is calculated by the toner concentration sensor 677, and the calculated value is set as a new target value SIG_INIT_Y. It is thereby possible to maintain the desired image density and the optimum gradation characteristic corrected in the first control using the developer-concentration control.

Figure 12:
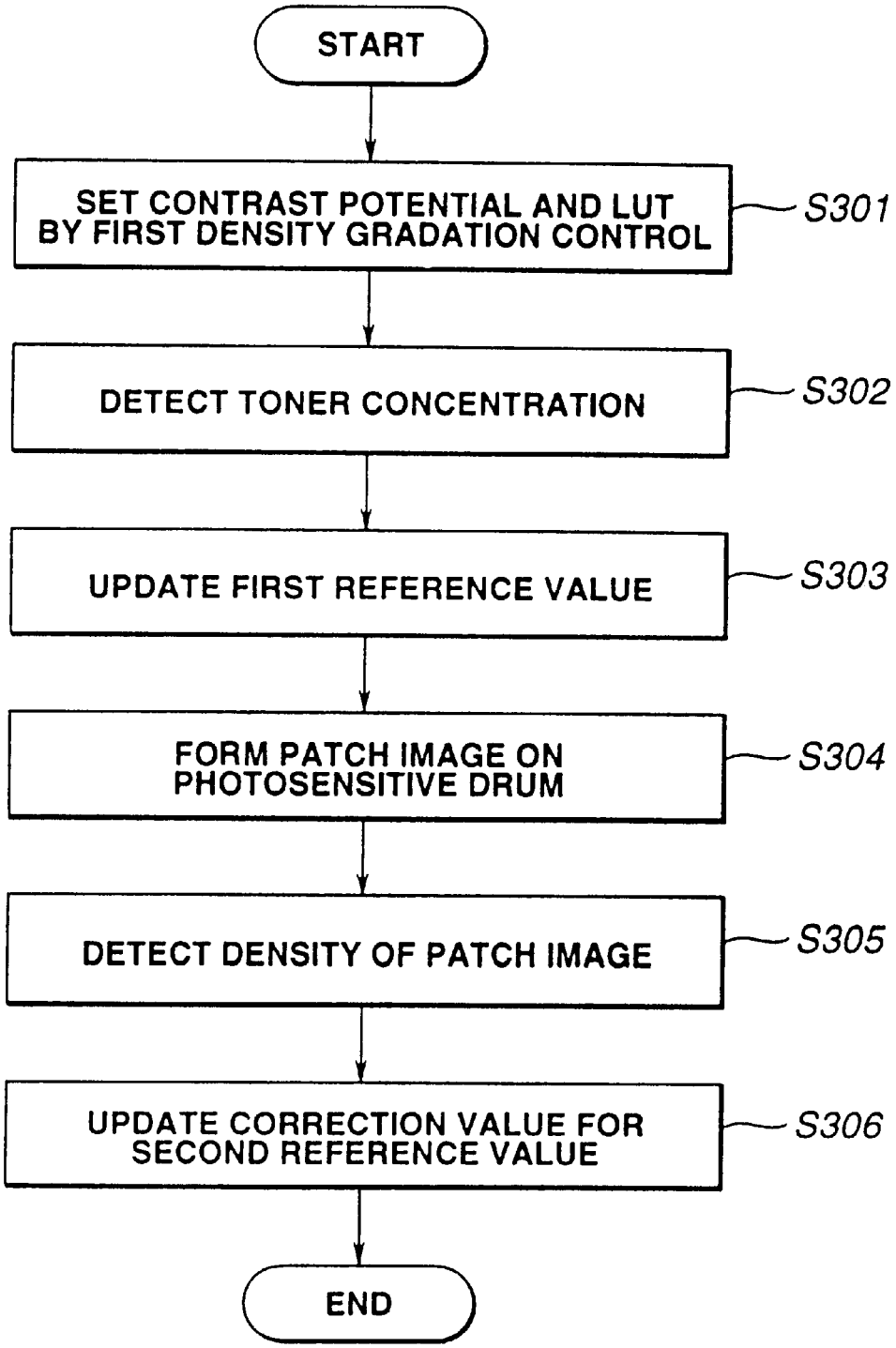
FIG. 12 is a flowchart illustrating procedures of reference-value updating processing for the second density/gradation control.
Figure 13:
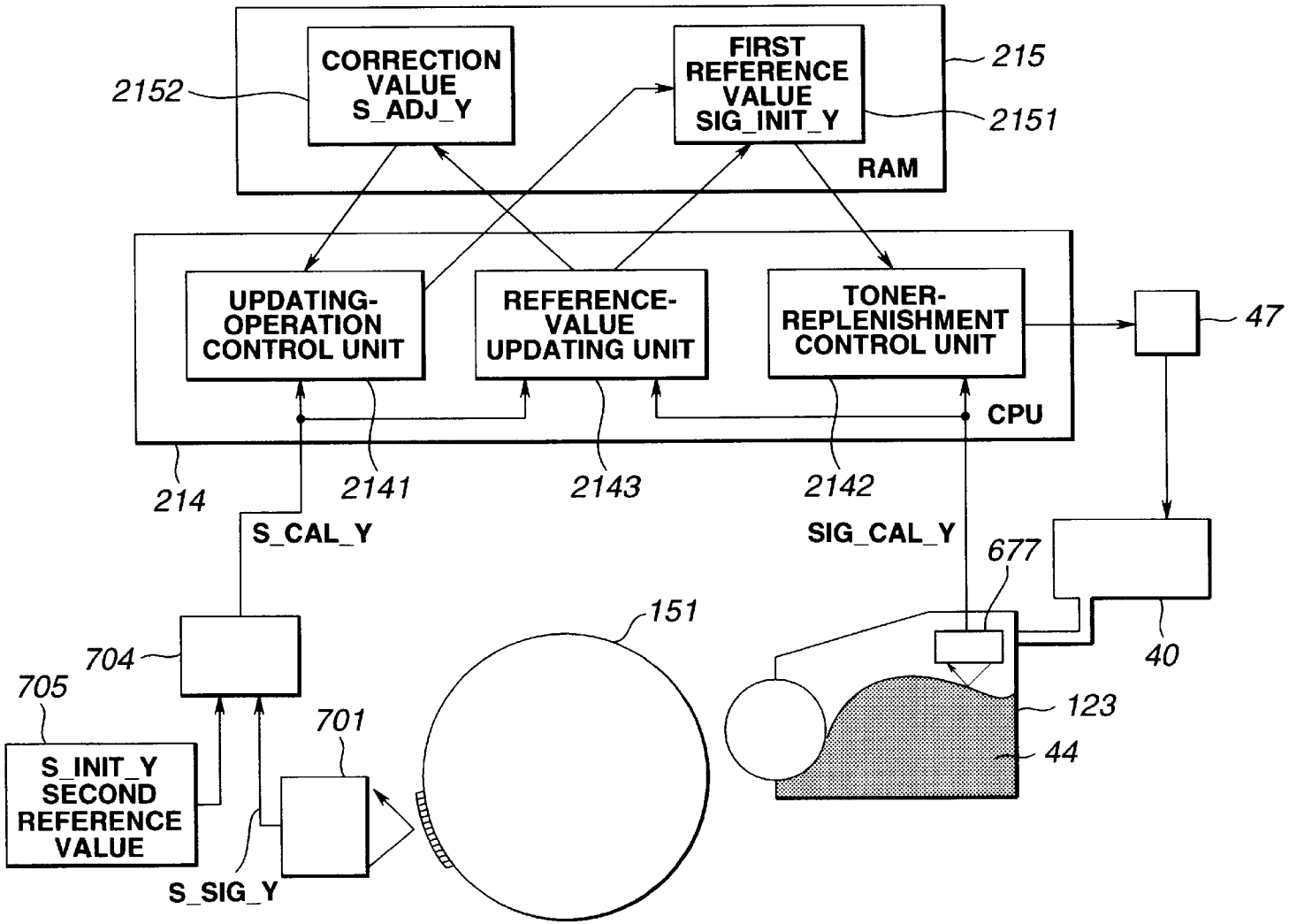
FIG. 13 is a block diagram illustrating the reference-value updating processing for the second density/gradation control.

The above-described processing will be further described with reference to FIGS. 12 and 13. FIG. 12 is a flowchart illustrating procesures of reference-value updating processing for the second density/gradation control. FIG. 13 is a block diagram illustrating the reference-value updating processing for the second density/gradation control.

In step S301, appropriate contrast potential and LUT are set by executing the first density/gradation control as shown in FIG. 3. Then, in step S302, the concentration of the developer 44 within the developing unit 123 is detected by the toner-concentration sensor 677 (step S302). A reference-value updating unit 2143 updates the first reference value (SIG_INIT_Y) within the RAM 215 by this detection signal SIG_CAL_Y (step S303).

Then, a patch image having a predetermined density is formed on the photosensitive drum 121 using the LUT 211 set in the first density/gradation control (step S304), and the density of the formed image is detected by the image-density sensor 701 (step S305). When a signal S_CAL_Y representing the difference between a detected value S_SIGY from the image-density sensor 701 and the second reference value S_INIT_Y from the reference-voltage signal source 705 has been acquired by the comparator 704, the reference-value updating unit 2143 updates the signal S_ADJ_Y representing the correction value 2152 by the difference signal S_CAL_Y (step S306). Thereafter, when performing the second density/gradation control, the first reference value is updated by operating the signal S_ADJ_Y for the signal S_CAL_Y. This is equivalent to updating of the second reference value to a value corresponding to the density value detected in the above-described step S305.

Using the first reference value and the second reference value updated in the above-described manner, the second density/gradation control by an updating-operation control unit 2141 and a toner-supply control unit 2142 is executed. The toner-supply control unit 2142 executes the above-described developer-concentration control (steps S203–S205), and the updating-operation control unit 2141 executes the above-described image-density control (steps S207–S212).

Although in the case of FIG. 13, the signal S_CAL_Y is obtained using the comparator 704 and the reference-voltage signal source 705, the signal S_CAL_Y may also be obtained using the CPU 214 and the RAM 215. In this case, a result obtained by adding signals S_INIT_Y and S_ADJ_Y may be stored in the RAM 215 as the second reference value after correction.

As described above, according to the first embodiment, the first density/gradation control and the second density/gradation control are performed, and the second density gradation control is adjusted based on the result of the first density/gradation control. As a result, it is possible to form a full-color image having stable density and gradation.

Second Embodiment

Next, a second embodiment of the present invention will be described. Since the configuration of the image forming apparatus and the method for forming a full-color image in the second embodiment are the same as in the first embodiment, a detailed description thereof will be omitted.

In the second embodiment, in order to prevent changes in the density and gradation of the obtained image and to perform stable control, the first density/gradation control is performed as in the first embodiment. As the second density/gradation control, the concentration of the developer is controlled by detecting the concentration of the toner of the developer within each developing unit by a toner-concentration sensor including an LED, serving as a light-emitting unit, and a photodiode, serving as a photosensing unit, provided within the developing unit, when forming a chromatic image (optical developer-concentration detection control).

As the second density/gradation control for black (Bk), a method of performing control by forming a test pattern on the photosensitive drum, and detecting the density of the formed image by an image-density sensor provided so as to face the photosensitive drum (image-density detection control), and a method of performing control by calculating a necessary amount of toner from the output level of a digital image signal representing each pixel from a video counter 720 (video counting control) are provided.

Figure 14:
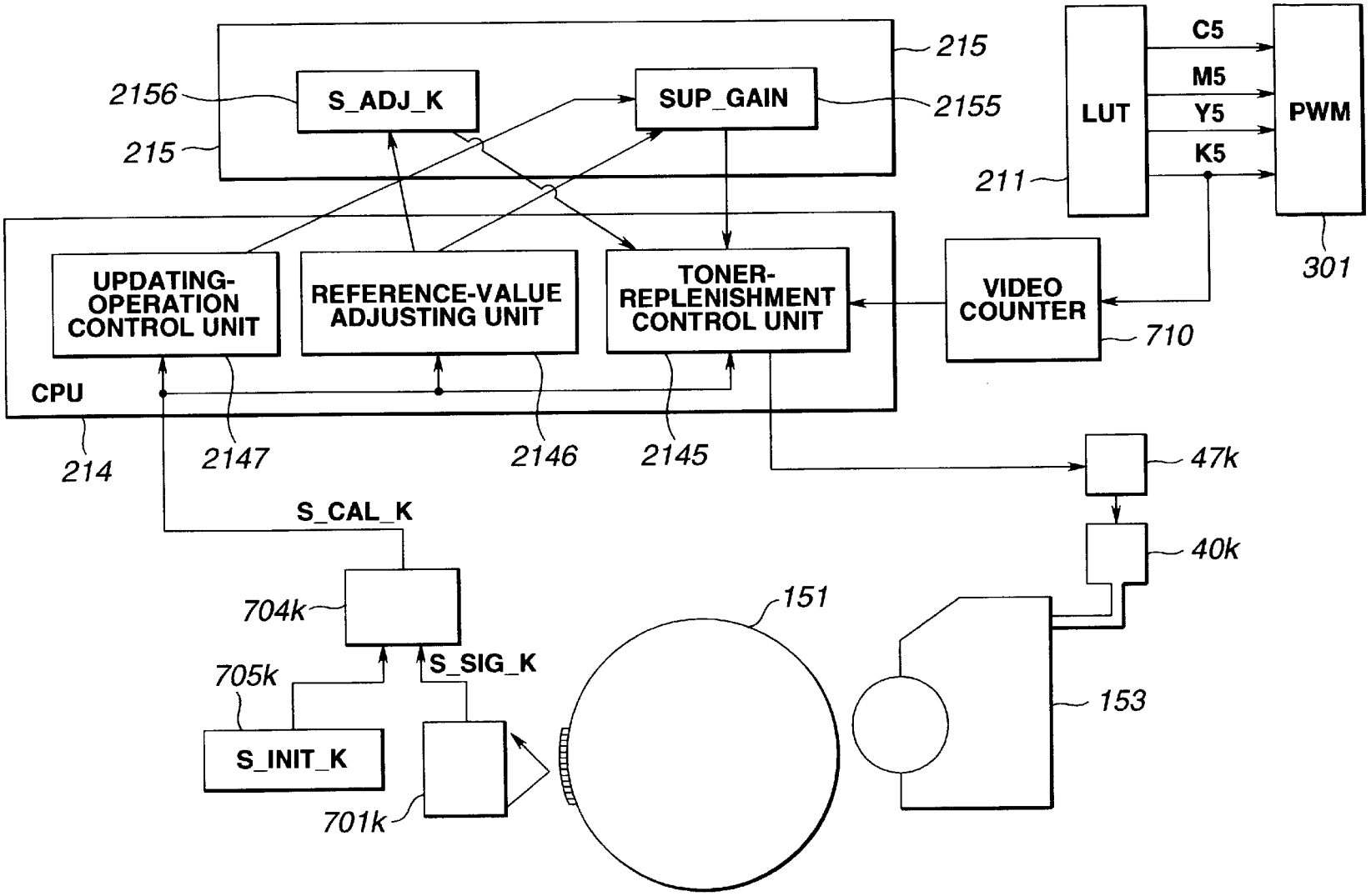
FIG. 14 is a block diagram illustrating density/gradation control in a black-image forming unit in a second embodiment of the present invention.

A description will now be provided of the second density/gradation control in a black-image forming unit. FIG. 14 is a block diagram illustrating density/gradation control in the black-image forming unit in the second embodiment.

First, image-density detection control will be described.

The image-density detection control is operated at a predetermined timing, and a patch image is formed on a photosensitive drum 151 as a reference image for density detection. The patch image is formed in the same manner as in the first embodiment. The density of the patch image is set to a value so that the developing characteristic can be most easily controlled. It is thereby possible to control not only the density but also the gradation of the image to desired characteristics according to the following control.

Then, the actual density of the patch image obtained in the above-described manner is detected using an image-density sensor 701*k*. The detected patch-image density corresponds to the toner concentration of the developer within the developing unit.

A comparator 704*k* obtains a density difference by comparing an output signal S_SIG_K indicating the patch-image density from the image-density sensor 701*k* with a second reference value (S_INIT_K) held in a reference-voltage signal source 705*k*, and supplies a CPU 214 with an output signal S_CAL_K representing the density difference. A tonersupply control unit 2145 controls a motor driving circuit 47*k* in accordance with the output signal S_CAL_K representing the density difference, to control the supply of the toner to the developer within a developing unit 153. That is, by not supplying the toner when the signal S_CAL_K is large, i.e., when the patch density is high, and by supplying the toner in accordance with the value of the signal S_CAL_K when the signal S_CAL_K is small, i.e., when the patch density is low, the density of the patch image is converged to a target value. As a result, the density and gradation of the obtained image are controlled.

However, since the above-described image-density detection control can be performed only once per image forming cycle, control when consecutively forming the same image is required. It is difficult to apply the optical developer-concentration detection control using reflected light to a black developer. Hence, in the second embodiment, a necessary amount of toner is accumulated from the output levels of digital image signals representing respective pixels, and the supply of the toner to the developer is controlled by performing video counting. That is, black-image data (K5) output from an LUT 211 is input to a video counter 710, and the count value is supplied to a toner-replenishment control unit 2145 of the CPU 214. The toner-replenishment control unit 2145 controls the replenishment of the toner by converting the count value from the video counter 710 into a toner supply amount by a conversion gain value 2155 (SUP_GAIN). As a result, the motor driving circuit 47*k* is driven, and the toner is replenished form a toner replenishing tank 40*k* into the developing unit 153.

In the above-described image-density detection control, an updating-operation control unit 2147 corrects the conversion gain value SUP_GAIN in the video counting control in accordance with the value of a density-output signal S_SIG_K. That is, when the signal S_SIG_K is small, since the image density is low and therefore the amount of consumption of the toner for the same output level is small, the gain SUP_GAIN is reduced. When the signal S_SIG_K is large, the gain is increased. It is thereby possible to always replenish an optimum amount of toner corresponding to the consumtion of the toner.

In the second embodiment, also, in order to effectively apply the first density/gradation control and the second density/gradation control, the second density/gradation control is adjusted based on the result of the first density/gradation control. The method of adjustment will now be described.

First, in image-density detection control, a patch image is output with a predetermined optimum density in order to guarantee gradation. That is, a patch image signal from a pattern generator 212 is transmitted to the LUT 211 to be subjected to γ conversion in order to obtain a desired density, and the resultant image is formed on the photosensitive drum 151.

As described above, the LUT 211 is appropriately changed by performing the first density/gradation control. Accordingly, the density of the patch formed on the photosensitive drum 151 is adjusted to a preset optimum density by performing the first density/gradation control. The patch image is formed using a newly set LUT, and a reference-value adjusting unit 2146 stores a density-difference ouptut signal S_CAL_K obtained from the detected image density S_SIG_K and the reference signal S_INIT_K in the RAM 215 as a reference-signal correction value 2156 (S_ADJ_K).

The toner-replenishment control unit 2145 determines the amount of replenishment of the toner based on a value obtained by adding/subtracting the correction value S_ADJ_K to/from the signal S_CAL_K. This is equivalent to performing image-density detection control by making a new correction reference signal S_AINIT_K obtained by adding/subtracting the correction value S_ADJ_K to/from the reference signal S_INIT_K to be the target density value. It is thereby possible to maintain a desired image density and an optimum gradation characteristic using image-density detection control corrected by the first density/gradation control.

When the first control is performed, the new reference signal S_AINT_K obtained by adding/subtracting the correction value S_ADJ_K to/from the reference signal S_INIT_K is set as the target density value. For that purpose, the reference-value adjusting unit 2146 returns the conversion gain value SUP_GAIN for the amount of replenishment of the toner to the developer by video counting control to the initial value. It is thereby possible to maintain the desired image density and optimum gradation characteristic corrected by the first control using developer-concentration control.

As described above, according to the second embodiment, by performing the first density/gradation control and the second density/gradation control, and adjusting the second density/gradation control based on the result of the first density/gradation control, it is possible to form an image having stable density and gradation.

In the foregoing embodiments, a description has been provided of the method of performing control by forming a test pattern on the photosensitive drum and detecting the density of the formed image by an image detection sensor (control by detecting the density of the image on the drum), the method of performing control by detecting the concentration of the toner of the developer by an optical toner-concentration sensor provided within each developing unit (control by optically detecting the concentration of the developer) when forming a chromatic image, and the method of controlling the concentration of the toner by video counting control when forming a black image. However, the present invention is not limited to such approaches. For example, as image-density detection control, a test pattern may be formed on a conveying belt, an intermediate transfer member, a recording material or the like, and control may be performed by detecting the density of the formed pattern by an image-density sensor. In another approach, as for detection of the concentration of the developer within the developing unit, the concentration of the toner of the developer may be detected by inductance-type toner-concentration sensor provided within the developing unit.

Although in the foregoing embodiments, a description has been provided of a four-drum-type full-color copier, the present invention is not limited to such a copier, but may also be applied to each kind of image forming apparatus, such as a full-color copier or a monocolor/multicolor copier of any other type, a copier other than an electrophotographic copier, or a copier including an image reading device, such as a scanner or the like. Although in the foregoing embodiments, image-density detection control in the second density/gradation control is performed by forming a patch image on the photosensitive drum, the present invention is not limited to such an approach. For example, an image-density detection unit including an LED, serving as a light-emitting unit, and a photodiode, serving as a photosensing unit, provided so as to face each other across a transfer belt, serving as a transparent recording-material bearing member using PET (polyethylene terephthalate) or the like, may be provided, a patch image formed on the photosensitive drum may be transferred onto the transfer belt, and the transmission density of the patch image may be detected by the image-density detection unit.

The present invention may be applied to a system comprising a plurality of apparatuses (such as a host computer, an interface apparatus, a reader, a printer and the like), or to an apparatus comprising a single unit (such as a copier, a facsimile apparatus or the like).

The objects of the present invention may, of course, be also achieved by supplying a system or an apparatus with a storage medium storing program codes of software for realizing the functions of the above-described embodiments, and reading and executing the program codes stored in the storage medium by a computer (or a CPU or an MPU (microprocessor unit)) of the system or the apparatus.

In such a case, the program codes themselves read from the storage medium realize the functions of the above-described embodiments, so that the storage medium storing the program codes constitutes the present invention.

For example, a floppy disk, a hard disk, an optical disk, a magnetooptical disk, a CD(compact disk)-ROM, a CD-R (recordable), a magnetic tape, a nonvolatile memory card, a ROM or the like may be used as the storage medium for supplying the program codes.

The present invention may, of course, be applied not only to a case in which the functions of the above-described embodiments are realized by executing program codes read by a computer, but also to a case in which an OS (operating system) or the like operating in a computer executes a part or the entirety of actual processing, and the functions of the above-described embodiments are realized by the processing.

The present invention may, of course, be applied to a case in which, after writing program codes read from a storage medium into a memory provided in a function expanding card inserted into a computer or in a function expanding unit connected to the computer, a CPU or the like provided in the function expanding card or the function expanding unit performs a part or the entirety of actual processing, and the functions of the above-described embodiments are realized by the processing.

As described above, according to the foregoing embodiments, it is possible to satisfactorily correct and control both short-term changes in the density and gradation of the obtained image due to changes in the environment and the like, and long-term changes in the density and gradation of the obtained image due to changes in the properties of the photosensitive member and the developer during the use of a long time period.

The individual components shown in outline or designated by blocks in the drawings are all well-known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

first forming means for forming a first pattern on a recording material;

first detection means for detecting a density of the first pattern;

first control means for controlling the image forming apparatus based on the density detected by said first detection means;

second forming means for forming a second pattern with toner on an image bearing member;

second detection means for detecting a density of the second pattern; and second control means for controlling the amount of toner supply in the image forming apparatus based on the density detected by said second detection means.

2. An image forming apparatus according to claim 1, further comprising image forming means for forming an electrostatic latent image corresponding to an image pattern on the image bearing member, and for transferring a developed image obtained by developing the electrostatic latent image onto the recording material.

3. An image forming apparatus according to claim 1, further comprising image forming means for forming an electrostatic latent image corresponding to an image pattern on the image bearing member, for transferring a developed image obtained by developing the electrostatic latent image onto an intermediate transfer member, and for transferring the image pattern on the intermediate transfer member onto the recording material.

4. An image forming apparatus according to claim 1, further comprising image forming means for forming a color image by sequentially forming images of a plurality of colors using the image bearing member.

5. An image forming apparatus according to claim 1, further comprising image forming means, having a plurality of image bearing members corresponding to a plurality of colors, for forming a color image by transferring visual images of the plurality of colors onto the recording material from the plurality of image bearing members.

6. An image forming apparatus according to claim 1, wherein said first detection means optically reads a recording material having the first pattern recorded thereon, and converts an obtained signal into density data by digitizing the signal.

7. An image forming apparatus according to claim 1, wherein said second detection means detects the density of the second pattern by projecting detection light onto the second pattern on the image bearing member and detecting light reflected therefrom.

8. An image forming apparatus according to claim 1, wherein said second detection means detects the density of the second pattern after transferring the second pattern formed on the image bearing member onto a recording-material holding member.

9. An image forming apparatus according to claim 8, wherein said second detection means detects the density of the second pattern by projecting detection light onto the second pattern on the recording-material holding member, and detecting light reflected therefrom or transmitted therethrough.

10. An image forming apparatus according to claim 3, wherein said second forming means transfers the second pattern formed on the image bearing member onto the intermediate transfer member, and wherein said second detection means detects the density of the second pattern formed on the intermediate transfer member.

11. An image forming apparatus according to claim 1, wherein said second forming means forms the second pattern on the recording material, and wherein said second detection means detects the density of the second pattern formed on the recording material.

12. An image forming apparatus according to claim 1, wherein said first control means controls a density or a gradation characteristic of the image while the visual image is formed, based on the density of the first pattern detected by said first detection means.

13. An image forming apparatus according to claim 11, wherein said first control means sets or adjusts a look-up table for controlling gradation based on an output density of the first pattern by said first forming means, and the density of the first pattern detected by said first detection means.

14. An image forming apparatus according to claim 10, wherein said first control means sets or adjusts a contrast voltage based on a density of a read first reference pattern.

15. An image forming apparatus according to claim 1, wherein said second control means controls a concentration of a developer so that the density detected from the second pattern by said second detection means equals a target value, and wherein said adjusting means changes the target value based on a result of control by said first control means.

16. An image forming apparatus according to claim 1, wherein said second control means further comprises:

developer-concentration control means for detecting a concentration of a developer, and for controlling the concentration of the developer by adjusting an amount of replenishment of the developer based on a detection signal representing the detected concentration of the developer and a set first target value; and target-value adjusting means for adjusting the first target value so that the density detected by said second detection means equals a second target value, and wherein said adjusting means adjusts the first and second target values based on a result of control by said first control means.

17. An image forming apparatus according to claim 1, wherein said second control means further comprises:

first concentration control means for detecting an amount of use of a developer based on data during image formation, and for controlling a concentration of the developer by adjusting an amount of replenishment of the developer based on the detected amount of use; and second concentration control means for replenishing the developer based on the difference between the density detected by said second detection means and a target density value, and wherein said adjusting means adjusts a relationship between the amount of use detected by said first concentration control means and the amount of replenishment, and the target density value for said second concentration control means, based on a result of control by said first control means.

18. An image forming apparatus according to claim 1, wherein the control by said first control means is executed based on an operator's instruction, and wherein the control by said second control means is automatically executed.

19. An image forming apparatus comprising:

forming means for forming a pattern with toner on a recording material via a visual-image forming process;

first control means for setting a parameter based on a value of density of the pattern formed by the visual-image forming process;

second control means for controlling the amount of toner supply in the image forming apparatus by maintaining the value of density of the pattern formed in the visual-image forming process to a predetermined target value; and adjusting means for forming a pattern by driving the visual-image forming process with the parameter set by said first control means, and for updating the predetermined target value based on a value of density of the formed pattern.

20. An image forming apparatus according to claim 19, wherein the pattern formed by said second control means is a pattern formed on a photosensitive drum.

21. An image forming apparatus according to claim 19, wherein said first control means further comprises:

potential setting means for setting a contrast potential based on a result of measurement of a density of a first pattern formed in the visual-image forming process; and generation means for forming a second pattern by driving the visual-image forming process with the contrast potential set by said potential setting means, and for generating a look-up table for γ-conversion processing based on a result of measurement of a density of the second pattern.

22. An image forming apparatus according to claim 19, wherein said second means further comprises:

toner-concentration control means for detecting a concentration of a toner, and for controlling the concentration of the toner by adjusting an amount of replenishment of the toner based on a detection signal representing the detected concentration of the toner and a set first target value; and target-value adjusting means for adjusting the first target value so that the density detected by second detection means equals a second target value, and wherein said adjusting means forms a pattern by driving the visual-image forming process with the parameter set by said first control means, and updates the target value to the second target value based on a result of measurement of a value of density of the formed pattern.

23. An image forming apparatus according to claim 22, wherein said adjusting means sets a concentration of the toner when driving the visual-image forming process with the set parameter as the first target value.

24. An image forming apparatus according to claim 19, wherein said second control means further comprises:

first concentration control means for detecting an amount of use of a toner based on data during image formation, for controlling a concentration of the toner by adjusting an amount of replenishment of the toner based on the detected amount of use;

second concentration control means for controlling replenishment of the toner based on the difference between the density value of the pattern formed in the visual-image forming process and the predetermined target value; and adjusting means for adjusting a relationship of conversion from the detected amount of use into an amount of replenishment of the toner by said first concentration control means, based on the density value of the formed pattern.

25. An image forming apparatus according to claim 24, wherein said adjusting means returns the relationship of convertion to an initial state when the visual-image forming process is driven by the set parameter.

26. A method for controlling an image forming apparatus, said method comprising:

a first forming step of forming a first pattern on a recording material;

a first detection step of detecting a density of the first pattern;

a first control step of controlling the image forming apparatus based on the density detected by said first detection step;

second forming step of forming a second pattern with toner on an image bearing member;

a second detection step of detecting a density of the second pattern; and a second control step of controlling the amount of toner supply in the image forming apparatus based on the density detected by said second detection step.

27. A method for controlling an image forming apparatus, said method comprising:

a forming step of forming a pattern with toner on a recording material via a visual-image forming process;

a first control step of setting a parameter based on a value of density of the pattern formed by the visual-image forming process;

a second control step of controlling the amount of toner supply in the image forming apparatus by maintaining the value of density of the pattern formed in the visual-image forming process to a predetermined target value; and an adjusting step of forming a pattern by driving the visual-image forming process with the parameter set by said first control step, and updating the predetermined target value based on a value of density of the formed pattern.

28. An image forming apparatus comprising:

first forming means for forming a first pattern on a recording material;

first detection means for detecting a density of the first pattern;

first control means for controlling the image forming apparatus based on the density detected by said first detection means;

second forming means for forming a second pattern with toner on an image bearing member;

second detection means for detecting a density of the second pattern;

second control means for controlling the amount of toner supply in the image forming apparatus based on the density detected by said second detection means;

adjusting means for adjusting a state of control by said second control means based on a result of control by said first control means; and image forming means for forming an electrostatic latent image corresponding to an image pattern on the image bearing member, for transferring a developed image obtained by developing the electrostatic latent image onto an intermediate transfer member, and for transferring the image pattern on the intermediate transfer member onto the recording material, wherein said second forming means transfers the second pattern formed on the image bearing member onto the intermediate transfer member, and wherein said second detection means detects the density of the second pattern formed on the intermediate transfer member.

29. An image forming apparatus comprising:

first forming means for forming a first pattern on a recording material;

first detection means for detecting a density of the first pattern;

first control means for controlling the image forming apparatus based on the density detected by said first detection means;

second forming means for forming a second pattern on an image bearing member;

second detection means for detecting a density of the second pattern;

second control means for controlling the image forming apparatus based on the density detected by said second detection means; and adjusting means for adjusting a state of control by said second control means based on a result of control by said first control means, wherein said second control means controls a concentration of a developer so that the density detected from the second pattern by said second detection means equals a target value, and wherein said adjusting means changes the target value based on a result of control by said first control means.

30. An image forming apparatus comprising:

first forming means for forming a first pattern on a recording material;

first detection means for detecting a density of the first pattern;

first control means for controlling the image forming apparatus based on the density detected by said first detection means;

second forming means for forming a second pattern on an image bearing member;

second detection means for detecting a density of the second pattern;

second control means for controlling the image forming apparatus based on the density detected by said second detection means;

adjusting means for adjusting a state of control by said second control means based on a result of control by said first control means, wherein said second control means further comprises:

developer-concentration control means for detecting a concentration of a developer, and for controlling the concentration of the developer by adjusting an amount of replenishment of the developer based on a detection signal representing the detected concentration of the developer and a set first target value; and target-value adjusting means for adjusting the first target value so that the density detected by said second detection means equals a second target value, and wherein said adjusting means adjusts the first and second target values based on a result of control by said first control means.

31. An image forming apparatus comprising:

first forming means for forming a first pattern on a recording material;

first detection means for detecting a density of the first pattern;

first control means for controlling the image forming apparatus based on the density detected by said first detection means;

second forming means for forming a second pattern on an image bearing member;

second detection means for detecting a density of the second pattern;

second control means for controlling the image forming apparatus based on the density detected by said second detection means;

adjusting means for adjusting a state of control by said second control means based on a result of control by said first control means, wherein said second control means further comprises:

first concentration control means for detecting an amount of use of a developer based on data during image formation, and for controlling a concentration of the developer by adjusting an amount of replenishment of the developer based on the detected amount of use; and second concentration control means for replenishing the developer based on the difference between the density detected by said second detection means and a target density value, and wherein said adjusting means adjusts a relationship between the amount of use detected by said first concentration control means and the amount of replenishment, and the target density value for said second concentration control means, based on a result of control by said first control means.

32. An image forming apparatus comprising:

first forming means for forming a first pattern on a recording material;

first detection means for detecting a density of the first pattern;

first control means for controlling the image forming apparatus based on the density detected by said first detection means;

second forming means for forming a second pattern on an image bearing member;

second detection means for detecting a density of the second pattern;

second control means for controlling the amount of toner supply in the image forming apparatus based on the density detected by said second detection means;

adjusting means for adjusting a state of control by said second control means based on a result of control by said first control means, wherein the control by said first control means is executed based on an operator's instruction, and wherein the control by said second control means is automatically executed.

33. An image forming apparatus comprising:

forming means for forming an pattern on a recording material via a visual-image forming process;

first control means for setting a parameter based on a value of density of the pattern formed by the visual-image forming process;

second control means for controlling a density of the recording material by maintaining the value of density of the pattern formed in the visual-image forming process to a predetermined target value; and adjusting means for forming a pattern by driving the visual-image forming process with the parameter set by said first control means, and for updating the predetermined target value based on a value of density of the formed pattern, wherein said first control means further comprises:

potential setting means for setting a contrast potential based on a result of measurement of a density of a first pattern formed in the visual-image forming process; and generation means for forming a second pattern by driving the visual-image forming process with the contrast potential set by said potential setting means, and for generating a look-up table for γ-conversion processing based on a result of measurement of a density of the second pattern.

34. An image forming apparatus comprising:

forming means for forming a pattern with toner on a recording material via a visual-image forming process;

first control means for setting a parameter based on a value of density of the pattern formed by the visual-image forming process;

second control means for controlling the amount of toner supply in the image forming apparatus by maintaining the value of density of the pattern formed in the visual-image forming process to a predetermined target value; and adjusting means for forming a pattern by driving the visual-image forming process with the parameter set by said first control means, and for updating the predetermined target value based on a value of density of the formed pattern, wherein said first control means further comprises:

first concentration control means for detecting an amount of use of a developer based on data during image formation, for controlling a concentration of the developer by adjusting an amount of replenishment of the developer based on the detected amount of use;

second concentration control means for controlling replenishment of the developer based on the difference between the density value of the pattern formed in the visual-image forming process and the predetermined target value; and adjusting means for adjusting a relationship of conversion from the detected amount of use into an amount of replenishment of the developer by said first concentration control means, based on the density value of the formed pattern.

* * * * *

UNITED STATES PATENT AND TRADEMARK OFFICE

CERTIFICATE OF CORRECTION

PATENT NO. : 6,115,561

DATED : September 5, 2000

INVENTOR : SATORU FUKUSHIMA

It is certified that error appears in the above-identified patent and that said Letters Patent is hereby corrected as shown below:

COLUMN 5

Line 28, "121" should read --121,--; and
Line 29, "transfer" should read --transfer,--.

COLUMN 6

Line 64, "twocomponent" should read --two component--.

COLUMN 7

Line 40, "Vcont" should read --$V_{cont}$--;
Line 66, "Regions" should read --Region--.

COLUMN 8

Line 1, "Regions" should read --Region--.

COLUMN 10

Line "light-emitting" should read --a light-emitting--.

UNITED STATES PATENT AND TRADEMARK OFFICE

CERTIFICATE OF CORRECTION

PATENT NO. : 6,115,561

DATED : September 5, 2000

INVENTOR : SATORU FUKUSHIMA

It is certified that error appears in the above-identified patent and that said Letters Patent is hereby corrected as shown below:

COLUMN 15

Line 37, "tonersupply" should read --toner-supply--.

Signed and Sealed this

First Day of May, 2001

*Attest:*

Nicholas P. Godici

NICHOLAS P. GODICI

*Attesting Officer*

*Acting Director of the United States Patent and Trademark Office*